US007681816B2

(12) United States Patent
Tanaka et al.

(10) Patent No.: US 7,681,816 B2
(45) Date of Patent: Mar. 23, 2010

(54) WOOD CRUSHER

(75) Inventors: Masamichi Tanaka, Tsukuba (JP); Masanori Shinooka, Kasumigaura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 685 days.

(21) Appl. No.: 11/579,606

(22) PCT Filed: Oct. 20, 2005

(86) PCT No.: PCT/JP2005/019318

§ 371 (c)(1),
(2), (4) Date: Nov. 3, 2006

(87) PCT Pub. No.: WO2006/043637

PCT Pub. Date: Apr. 27, 2006

(65) Prior Publication Data

US 2008/0283643 A1 Nov. 20, 2008

(30) Foreign Application Priority Data

Oct. 21, 2004 (JP) ..... 2004-306408

(51) Int. Cl.
*B02C 13/26* (2006.01)
*B27L 11/00* (2006.01)

(52) U.S. Cl. ..... 241/89.1; 241/101.74

(58) Field of Classification Search ..... 241/32, 241/73, 186.35, 186.4, 189.1, 285.3, 89.1, 241/89.2, 101.74, 101.741, 101.5, 101.76
See application file for complete search history.

(56) References Cited

U.S. PATENT DOCUMENTS

| | | | | | |
|---|---|---|---|---|---|
| 4,146,184 | A * | 3/1979 | Whitney | 241/73 |
| 4,385,732 | A * | 5/1983 | Williams | 241/236 |
| 5,213,273 | A * | 5/1993 | Linnerz | 241/73 |
| 5,743,472 | A * | 4/1998 | Williams et al. | 241/32 |
| 5,863,003 | A * | 1/1999 | Smith | 241/73 |
| 6,299,082 | B1 * | 10/2001 | Smith | 241/186.35 |
| 7,222,805 | B1 * | 5/2007 | Williams, Jr. | 241/89.1 |
| 2003/0141394 | A1 * | 7/2003 | Ueda et al. | 241/73 |
| 2007/0241218 | A1 * | 10/2007 | Peterson et al. | 241/73 |

FOREIGN PATENT DOCUMENTS

| | | |
|---|---|---|
| JP | 2002-224583 | 8/2002 |
| JP | 2002-346418 | 12/2002 |
| JP | 2004-202365 | 7/2004 |

* cited by examiner

*Primary Examiner*—Faye Francis
(74) *Attorney, Agent, or Firm*—Mattingly & Malur, P.C.

(57) ABSTRACT

A wood crusher having a crushing apparatus includes a crushing rotor for crushing target wood to be crushed, a second screen detachably mounted on the outer peripheral side of the crushing apparatus and a screen support member disposed on the outer peripheral side of the second screen and holding the second screen in a position on the outer peripheral side of the crushing apparatus. A link mechanism is coupled to the screen support member, and a hydraulic cylinder is coupled to the link mechanism to advance and retract the screen support member relative to the crushing apparatus with extension and contraction thereof. Time and labor required for work of replacing the sieve member can be greatly reduced as a result.

6 Claims, 12 Drawing Sheets

WOOD CRUSHER

TECHNICAL FIELD

The present invention relates to a wood crusher for crushing cut limbs, timbers from thinning, branches, scrap woods, etc., and more particularly to a wood crusher in which, for example, a crushing rotor is rotated to crush target woods to be crushed.

BACKGROUND ART

For example, cut limbs and timbers from thinning, which are generated when cutting down trees in forests and trimming the trees, branches generated with land development, green tract maintenance, etc., and scrap woods having been used in broken-down wooden houses are usually finally discarded as industrial wastes. A wood crusher is employed in such a waste treating process to crush target woods into predetermined sizes at the work site before transport for the purpose of, e.g., reducing the volume of the crushed woods as wastes, or breaking the crushed woods into wood chips and fermenting the chips for reuse as organic fertilizer.

That type of wood crusher comprises a crushing rotor including crushing bits disposed in an outer peripheral portion of the rotor, a sieve member disposed around such a crushing apparatus, a sieve member holding means (support member) for holding the sieve member in a position around the crushing apparatus, and a moving mechanism for moving the sieve member holding means to a position where the sieve member is replaced (see, e.g., Patent Document 1). In that wood crusher, target woods are crushed by the crushing bits provided on the crushing rotor. When the crushed woods (wood chips) are broken into pieces smaller than an area of each of many openings formed in the sieve member, those wood chips are discharged to the exterior through the openings. Because the grain size of the crushed woods is decided substantially depending on the opening area of the sieve member, an adjustment of the grain size of the crushed woods is performed by preparing plural kinds of sieve members and replacing one sieve member with another as required. The replacement of the sieve member is performed by moving the sieve member holding means with the aid of the moving mechanism to a position where the sieve member is replaced, and mounting the desired sieve member after dismounting the current one. The moving mechanism comprises a sling bolt and a support member (shaft member) which is disposed at one end of the sieve member holding means rotatably supported by a bracket and which is screwed with the sling bolt for supporting the sieve member holding means at a predetermined position. When the sling bolt is rotated, the support member screwed with the sling bolt is vertically moved in response to the rotation of the sling bolt. As a result, the sieve member holding means is turned with the other end thereof serving as a pivot axis so that the sieve member is moved to the replacement position.

Patent Document 1: JP, A 2002-346418

DISCLOSURE OF THE INVENTION

Problems to be Solved by the Invention

In the above-described related art, when the sieve member is replaced, the sieve member holding means is moved by rotating the sling bolt. However, because the rotation of the sling bolt is manually performed by an operator using a tool, e.g., a wrench, time and labor are taken for the work of replacing the sieve member. Further, in the above-described related art, the support member (shaft member) for supporting the one end side of the sieve member holding means and the sling bolt are disposed at two positions in the axial direction of the crushing rotor. Therefore, the operator has to vertically move the sieve member holding means while substantially evenly rotating two sling bolts which are disposed at those two positions away from each other. In particular, when the replacement work is performed by one person, a lot of time and labor are required.

The present invention has been made in view of the above-described problems with the related art, and its object is to provide a wood crusher capable of greatly reducing time and labor required for the work of replacing a sieve member.

Means for Solving the Problems (1) To achieve the above object, the present invention provides a wood crusher comprising a crushing apparatus including a crushing rotor for crushing target woods to be crushed; a sieve member detachably mounted on the outer peripheral side of the crushing apparatus; sieve member holding means disposed on the outer peripheral side of the sieve member and holding the sieve member in a position on the outer peripheral side of the crushing apparatus; a link mechanism coupled to the sieve member holding means; and extension/contraction drive means coupled to the link mechanism and advancing and retracting the sieve member holding means relative to the crushing apparatus with extension and contraction thereof.

Generally, in a wood crusher in which a grain size of crushed woods (wood chips) having been broken into pieces by a crushing apparatus is decided depending on a sieve member, the grain size of the crushed woods is adjusted, for example, by preparing plural kinds of sieve members having different opening areas from each other and by replacing those screens as required.

In the present invention, by operating the extension/contraction drive means to extend and contract, the sieve member holding means is advanced and retracted relative to the crushing apparatus through the link mechanism. More specifically, in ordinary crushing work, for example, the extension/contraction drive means is extended to move the sieve member holding means to a position closest to the crushing apparatus (i.e., a set position), thereby setting the sieve member in place. When the sieve member is replaced, the extension/contraction drive means is contracted to move the sieve member holding means to a position for replacement of the sieve member (i.e., a replacement position), followed by performing work of replacing the sieve member. Thus, the sieve member holding means can be easily moved to the replacement position when the sieve member is replaced, and after the replacement work, the sieve member holding means can be easily returned to the set position. Accordingly, in comparison with the related art in which the operator performs the replacement of the sieve member by manually rotating the sling bolt with a tool, e.g., a wrench, and moving the sieve member holding means to the replacement position, time and labor required for the replacement work can be greatly reduced. Further, in the case of, for example, a structure in which the sieve member holding means is supported at plural points in the axial direction of the crushing rotor, the related art requires a lot of time and labor because of the necessity of evenly rotating the plurality of sling bolts especially when the replacement work is performed by one person. In contrast, with the present invention, by constituting the extension/contraction drive means as a hydraulic cylinder, for example, a plurality of hydraulic cylinders can be evenly operated just by manipulating a control switch or the like, and the replacement work can be performed by easily moving the sieve member holding means even in the case of only one operator. Thus, the present invention can realize a great reduction in time and labor required for the replacement work of the sieve member.

(2) In above (1), preferably, the link mechanism moves the sieve member holding means in a direction toward the crushing apparatus when the extension/contraction drive means is extended, and moves the sieve member holding means in a direction away from the crushing apparatus when the extension/contraction drive means is contracted.

(3) In above (2), more preferably, the link mechanism is coupled to one end of the extension/contraction drive means and comprises a first link member movable in the extending and contracting direction of the extension/contraction drive means and a second link member having one end rotatably coupled to the sieve member holding means and the other end rotatably coupled to the first link member.

In the present invention, the link mechanism operates as follows. When the extension/contraction drive means is maximally contracted, the first link member and the second link member of the link mechanism are in a substantially fully extended state, and the sieve member holding means is located in the replacement position most away from the crushing apparatus. As the extension/contraction drive means is extended from the above state, the first link member is moved in the extending direction of the extension/contraction drive means and the second link member is turned such that the first link member and the second link member cross each other at a gradually increasing angle and the sieve member holding means is moved in a direction gradually approaching the crushing apparatus. Finally, when the extension/contraction drive means is maximally extended, the first link member and the second link member come into an angularly coupled state crossing each other substantially at a right angle, and the sieve member holding means is located in the set position closest to the crushing apparatus. Thus, according to the present invention, the extension and contraction of the extension/contraction drive means can be smoothly converted to the retracting and advancing movements of the sieve member holding means relative to the crushing apparatus with a simple construction.

(4) In above (3), more preferably, the wood crusher further comprises a guide member for guiding a direction in which the first link member is moved, and for bearing a vertical load received by the first link member from the second link member.

As described in above (3), when the sieve member holding means is in the set position, the first link member and the second link member of the link mechanism come into the angularly coupled state crossing each other substantially at a right angle. Therefore, forces acting on the sieve member and the sieve member holding means during the crushing work act as a substantially vertical load imposed on the first link member through the second link member. In the present invention, the guide member bears the vertical load received by the first link member from the second link member. Thus, since the forces acting on the sieve member and the sieve member holding means during the crushing work can be borne substantially only by the guide member, there is no need of providing another locking means for fixing the sieve member holding means in the set position. Stated another way, in the present invention, the sieve member holding means can be moved to and locked in the set position by only one action of extending the extension/contraction drive means. It is hence possible to cut time and labor required for the work of returning the sieve member to the proper position after the replacement thereof, and to realize the advantage of reducing total time and labor required for the replacement work of the sieve member. In addition, the present invention can also realize the advantage of greatly reducing the external force acting on the extension/contraction drive means when the sieve member holding means is in the set position.

(5) In above (3) or (4), an end of the sieve member holding means on the side oppositely away from the second link member is rotatably supported to a frame of the crushing apparatus about a pin serving as a fulcrum, which is extended parallel to a rotation center of the crushing rotor, and the sieve member holding means is held in a sandwiched state between a retainer plate fixed to the frame and the sieve member holding means.

(6) In any of above (3) to (5), the link mechanism is constituted such that an angle formed between a plane passing rotation centers of pins at opposite ends of the second link member and a plane passing the rotation center of the pin which couples the first and second link members and extending in the extending/contracting direction of the first link member is not larger than 90 degrees during crushing work, the angle representing an angle formed above the plane extending in the extending/contracting direction of the first link member on the side of the pin, which couples the first and second link members, closer to the crushing rotor.

(7) In any of above (3) to (6), the link mechanism is constituted such that an angle formed between a plane passing rotation centers of pins at opposite ends of the second link member and a plane passing the rotation center of the pin which couples the sieve member holding means and the second link member and passing a rotation center of the crushing rotor is 90 degrees during crushing work.

(8) To achieve the above object, the present invention also provides a wood crusher comprising a crushing apparatus including a crushing rotor for crushing target woods to be crushed; a sieve member having a curved surface and detachably mounted on the outer peripheral side of the crushing apparatus; sieve member holding means for holding the sieve member in a position on the outer peripheral side of the crushing apparatus; an abutment member having an abutment surface formed in conformity with the curved surface of the sieve member; and extension/contraction drive means for advancing and retracting the abutment member relative to the sieve member in a direction that is inclined relative to a direction normal to an abutment portion between the sieve member and the extension/contraction drive means.

In the present invention, by operating the extension/contraction drive means to extend and contract, the abutment member is advanced and retracted relative to the sieve member. More specifically, in ordinary crushing work, for example, the extension/contraction drive means is extended to move the abutment member into abutment against the sieve member, thereby fixing the sieve member in place. When the sieve member is replaced, the extension/contraction drive means is contracted to move the abutment member away from the sieve member, whereby the sieve member is released from the fixed state and brought into a detachable state. Thus, the sieve member can be easily brought into a replaceable state by releasing the sieve member from the state fixed by the abutment member when the sieve member is replaced. Accordingly, in comparison with the related art in which the operator performs the replacement of the sieve member by manually rotating the sling bolt with a tool, e.g., a wrench, and moving the sieve member holding means to the replacement position, time and labor required for the replacement work can be greatly reduced.

Further, in the present invention, the abutment member is advanced and retracted in the direction inclined relative to the direction normal to the abutment portion between the sieve member and the abutment member such that the abutment member is abutted against the sieve member in the inclined direction. Assuming, for example, a structure in which the abutment member is abutted against the sieve member in the direction normal to the sieve member, a force acting on the sieve member outward in the normal direction during the crushing work directly acts on the extension/contraction drive means through the abutment member. In contrast, with this embodiment, because of employing the structure in which the abutment member is abutted against the sieve member in the direction inclined relative to the normal direction, only a component of the force acting on the sieve member during the crushing work acts on the extension/contraction drive means. As a result, the external force acting on the extension/contraction drive means can be greatly reduced.

(9) In above (8), preferably, the wood crusher further comprises a locking device for preventing movement of the abutment member when the abutment member is in a state abutted against the sieve member or a state most away from the sieve member.

(10) In above (8) or (9), preferably, the wood crusher further comprises a guide member for guiding a direction in which the abutment member is moved, the abutment member being pushed like a wedge into between the sieve member and the guide member.

(11) In any of above (1) to (10), preferably, the extension/contraction drive means are each a hydraulic cylinder.

ADVANTAGES OF THE INVENTION

According to the present invention, since the sieve member holding means can be easily moved to the position for replacement of the sieve member by making the sieve member holding means movable toward and away from the crushing apparatus with the operation of the extension/contraction drive means, time and labor required for the replacement work of the sieve member can be greatly reduced.

Also, according to the present invention, since the sieve member can be easily released from the state fixed by the abutment member by making the abutment member movable toward and away from the sieve member with the operation of the extension/contraction drive means, time and labor required for the replacement work of the sieve member can be greatly reduced.

REFERENCE NUMERALS

Figure 1:
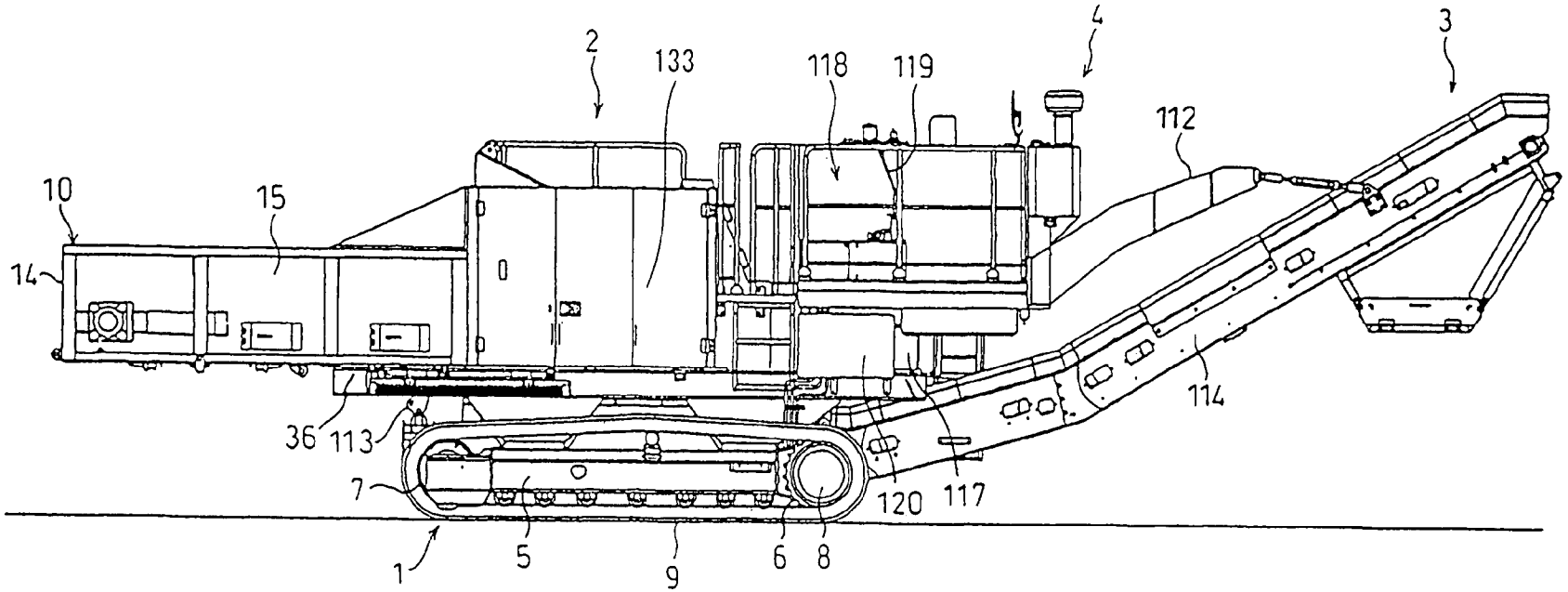
FIG. 1 is a side view showing an overall structure of one embodiment of a wood crusher according to the present invention.

12 crushing apparatus
45 frame
61 crushing rotor
63 guide member
69 first screen (sieve member)
70 first screen (sieve member)
74 screen support member (sieve member holding means)
79 abutment member
79*a* abutment surface
80 hydraulic cylinder (extension/contraction drive means)
85 locking member (locking device)
87 retainer plate
88 hydraulic cylinder (extension/contraction drive means)
91 link mechanism
92 slide link (first link member)
93, 93*a* pins
94 hold link (second link member)
96 guide member
98 screen support member (sieve member holding means)
99 pin
○ rotation center
S1-S3 planes
α, β angles

BEST MODE FOR CARRYING OUT THE INVENTION

One embodiment of a wood crusher according to the present invention will be described below with reference to the drawings.

Figure 2:
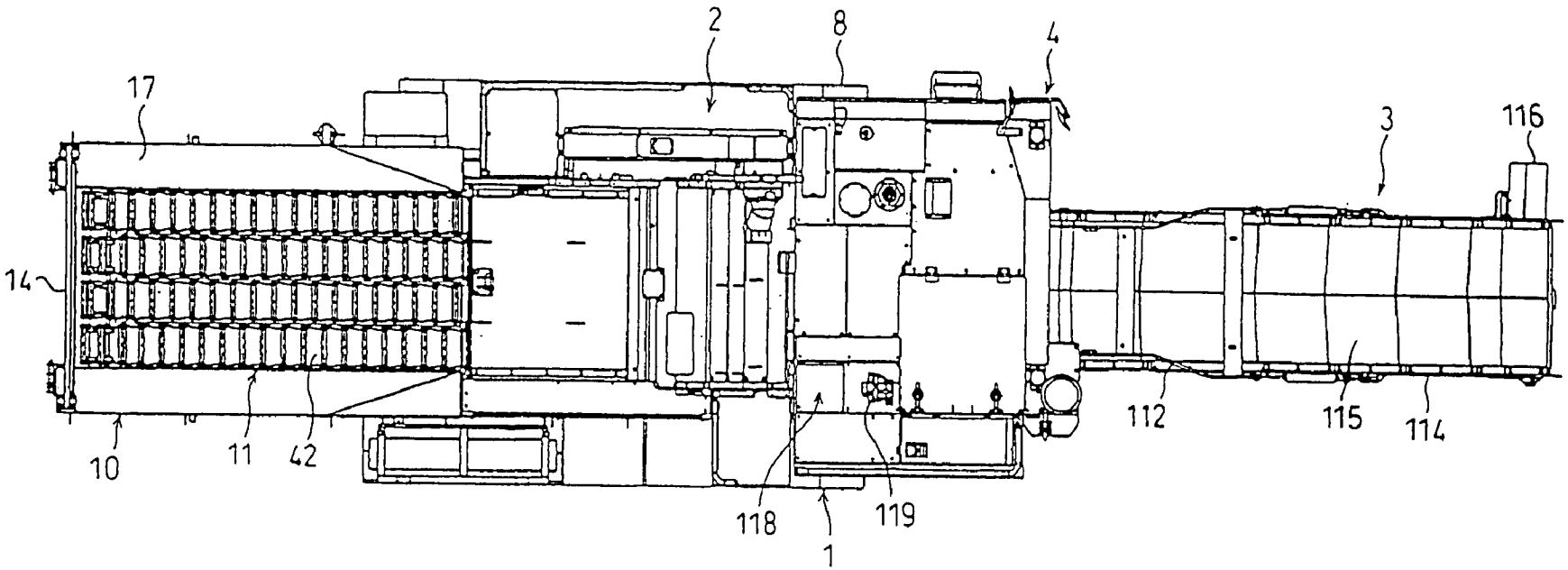
FIG. 2 is a plan view showing the overall structure of one embodiment of the wood crusher according to the present invention.
Figure 3:
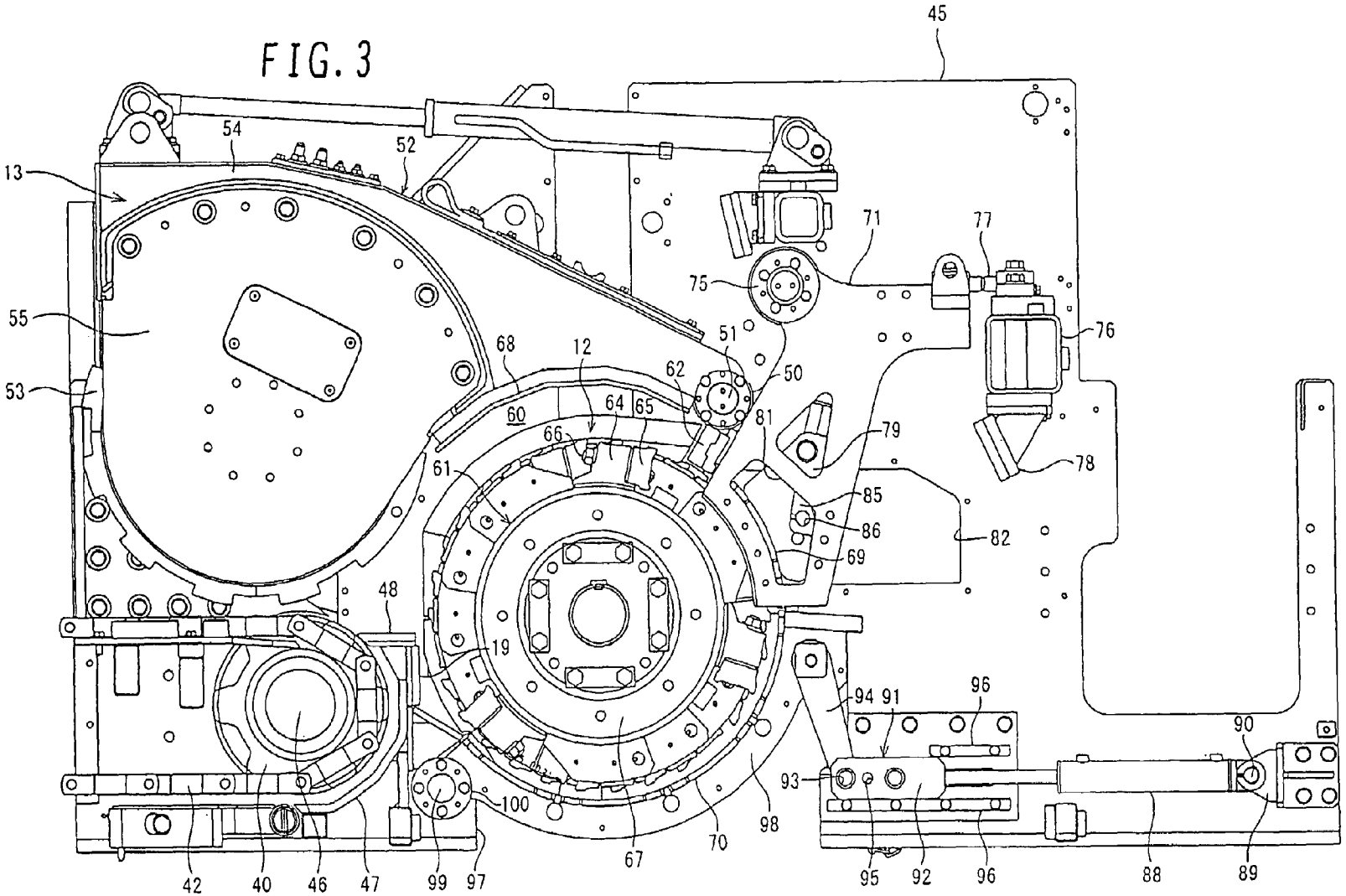
FIG. 3 is a side view showing a detailed structure within a side cover in the vicinity of a crushing apparatus provided in one embodiment of the wood crusher according to the present invention.

FIG. 1 is a side view showing an overall structure of a self-propelled wood crusher as one embodiment of the wood crusher according to the present invention, FIG. 2 is a plan view of the self-propelled wood crusher shown in FIG. 1, and FIG. 3 is a side view showing a detailed structure within a side cover 45 in the vicinity of a crushing apparatus 12 described later. Note that, in the following description, directions corresponding to the left and right in FIG. 1 are assumed to represent respectively the front and rear of the wood crusher or one side and the other side thereof.

Referring to FIGS. 1 to 3, reference numeral 1 denotes a travel body capable of being self-propelled, and 2 denotes a crushing function structure installed on the travel body 1 and crushing target woods loaded to be crushed. Numeral 3 denotes a discharge conveyor for conveying the woods having been crushed in the crushing function structure 2 and discharging the crushed woods to the exterior of the crusher, and 4 denotes motive power equipment (power unit) including a power source (engine), etc. for various components mounted in the crusher. Thus, the self-propelled wood crusher of this embodiment comprises primarily the travel body 1, the crushing function structure 2, the discharge conveyor 3, the power unit 4, etc.

The travel body 1 comprises a track frame 5, a drive wheel 6 and a driven wheel 7 disposed respectively at longitudinal opposite ends of the track frame 5, a driving unit (i.e., hydraulic motor for travel) 8 having an output shaft coupled to a shaft of the drive wheel 6, and a crawler (caterpillar belt) 9 looped over the drive wheel 6 and the driven wheel 7. Numeral 36 denotes a body frame disposed on the track frame 5. The body frame 36 supports the crushing function structure 2, the discharge conveyor 3, the power unit 4, etc.

The crushing function structure 2 comprises a hopper 10 for receiving the loaded target woods, a feed conveyor 11 serving as feed means for feeding the target woods loaded into the hopper 10, a crushing apparatus 12 (see FIG. 3) for crushing the target woods introduced by the feed conveyor 11, and a pressing conveyor unit 13 (see FIG. 3) for pressing the target woods, which is going to be introduced to the crushing apparatus 12, against the feed conveyor 11 at a position in front of the crushing apparatus 12.

Figure 4:
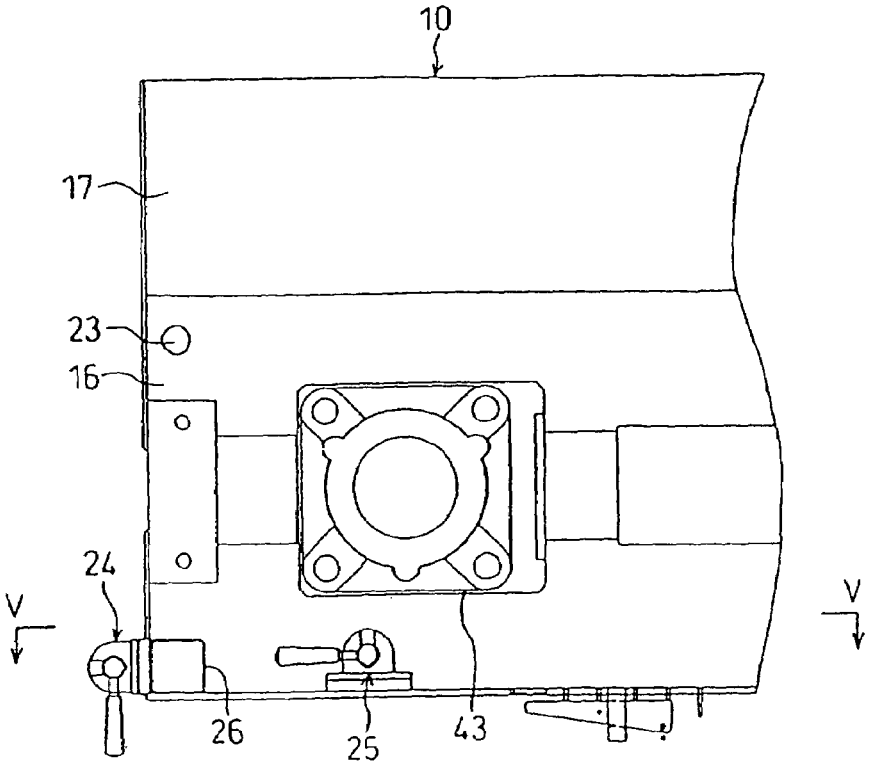
FIG. 4 is a side view showing a detailed structure in the vicinity of a rear end of a hopper provided in one embodiment of the wood crusher according to the present invention.
Figure 5:
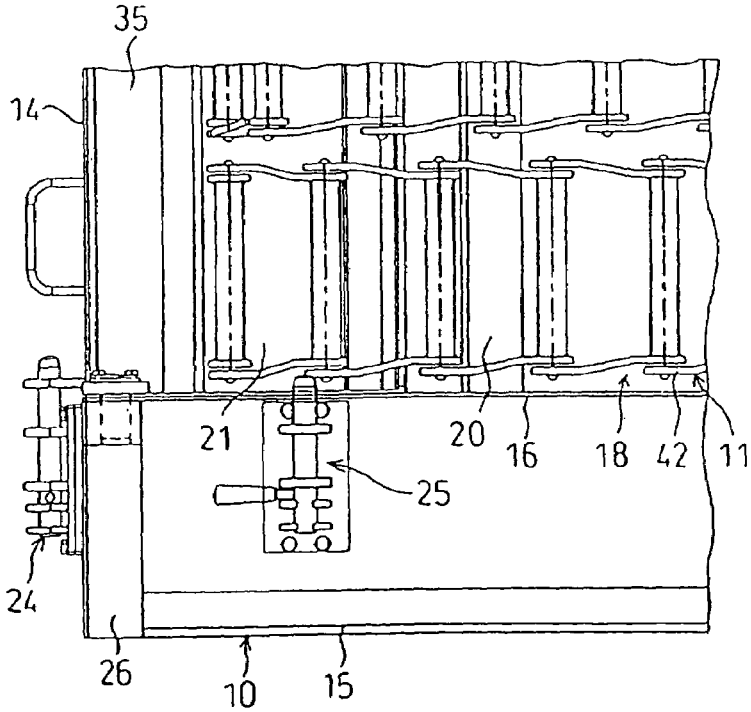
FIG. 5 is a sectional view taken along the line V-V in FIG. 4 and looking in the direction of an arrow, the view showing a detailed structure in the vicinity of the rear end of the hopper provided in one embodiment of the wood crusher according to the present invention.
Figure 6:
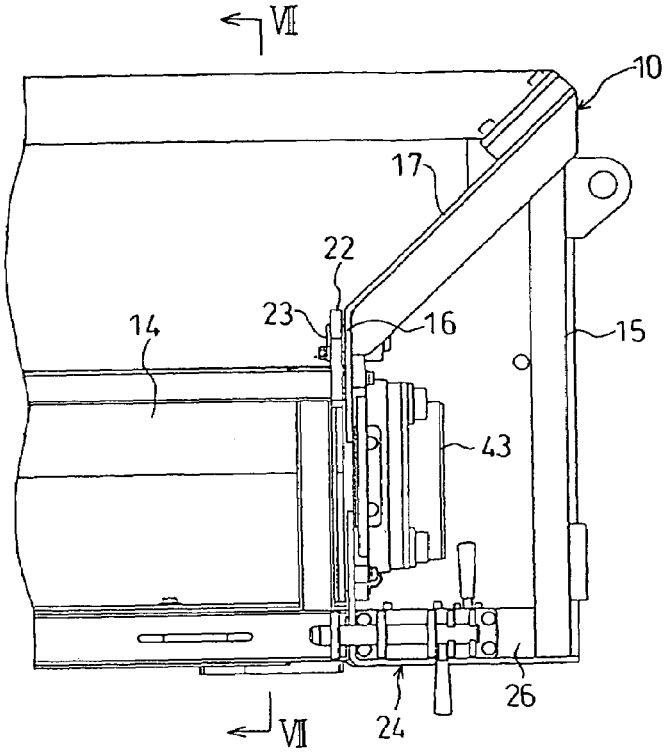
FIG. 6 is a direct rear view looking from the rear of the hopper, the view showing a detailed structure in the vicinity of the rear end of the hopper provided in one embodiment of the wood crusher according to the present invention.

FIG. 4 is a side view showing a detailed structure in the vicinity of a rear end of the hopper 10, FIG. 5 is a sectional view taken along the line V-V in FIG. 4 and looking in the direction of an arrow, and FIG. 6 is a direct rear view of the hopper 10 looking from the rear thereof. Similar components in FIGS. 4-6 to those in the above-described drawings are denoted by the same symbols and a description of those components is omitted here. Note that FIG. 4 shows a state where an outer wall 15, described later, is removed.

Referring to FIGS. 4-6, the hopper 10 is in the bottom-equipped form and is installed to extended substantially horizontally on the rear side of a crushing rotor 61 (described later) installed on the body frame 36. The hopper 10 comprises a rear wall 14 disposed behind the feed conveyor 11, outer walls 15 disposed on both sides in the transverse direction of the feed conveyor 11, L-shaped side walls 16 each made up of plural members and disposed inside the outer walls 15 on both sides in the transverse direction of the feed conveyor 11 while leaving gaps relative to the outer walls 15, a spreading (flaring) portion 17 provided above the outer walls 15 and the side walls 16 so as to straddle between them and to gradually spread upward, a bottom wall 18 formed to extend over an entire bottom surface and positioned under the feed conveyor 11 while leaving a slight gap relative to the feed conveyor 11, and a front wall 19 (see FIG. 3) disposed at a front end. An upper end of the rear wall 14 is set flush with or slightly higher than a conveying surface of the feed conveyor 11, and an upper end of the front wall 19 is set slightly lower than the conveying surface of the feed conveyor 11.

Figure 7:
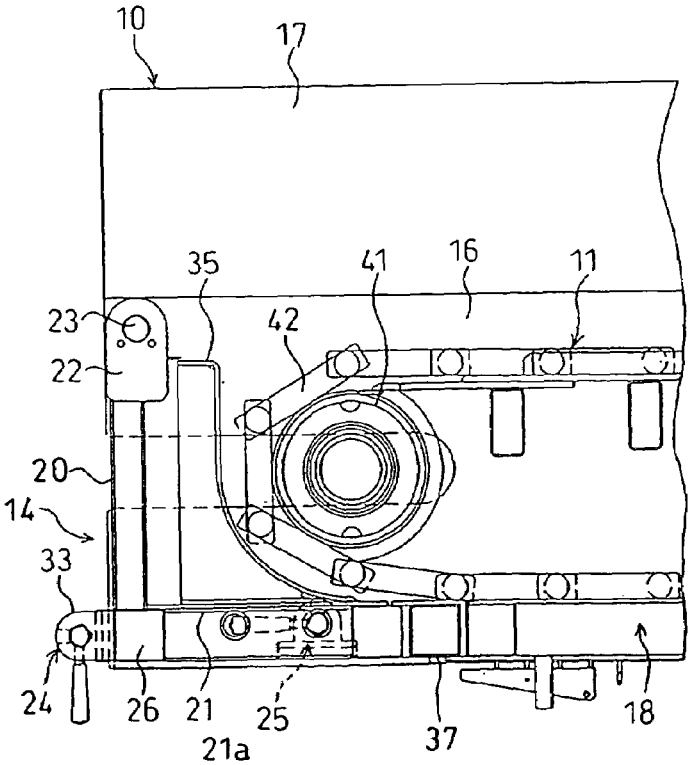
FIG. 7 is a sectional view taken along the line VII-VII in FIG. 6 and looking in the direction of an arrow, the view showing a detailed structure of a rear end portion of a feed conveyor provided in one embodiment of the wood crusher according to the present invention.

FIG. 7 is a sectional view taken along the line VII-VII in FIG. 6 and looking in the direction of an arrow, the view showing a detailed structure of a rear end portion of the feed conveyor 11. Similar components in FIG. 7 to those in the above-described drawings are denoted by the same symbols and a description of those components is omitted here.

In this embodiment, the rear wall 14 of the hopper 10 is made up of a rear wall portion 20 positioned at the rear end of the hopper 10 and a bottom wall portion 21 extending substantially perpendicularly from a lower end of the rear wall portion 20, the portions 20 and 21 being formed in an integral structure having a nearly L-shape as viewed from side. The bottom wall portion 21 is substantially horizontally extended from the lower end of the rear wall portion 20 to a position under a driven wheel 41 (described later) of the feed conveyor 11 while lying substantially on the same plane as the bottom 18 with a beam 37 interposed between them. Thus, the bottom wall portion 21 constitutes a bottom portion of the hopper 10 together with the bottom wall 18. A pin 23 is attached to an upper end of the rear wall portion 20 through a bracket 22, and the rear wall portion 20 is mounted to the side walls 16 to be rotatable about the pin 23 serving as a fulcrum. With such an arrangement, the rear wall portion 20 and the bottom wall portion 21 (i.e., the rear wall 14) are rotated together such that a rear end portion of the hopper 10 can be opened and closed as required. Additionally, a guide member 35 is mounted on the bottom wall portion 21 and is formed substantially in a circular-arc shape so as to extend in proximity to a locus along which a rear end of the feed conveyor 11 turns, thereby preventing the loaded target woods from entering a space behind the feed conveyor 11.

Numerals 24, 25 denote locking mechanisms that serve to hold the rear wall 14 in a closed state. The locking mechanism 24 is provided on a rear end surface of a beam 26 extending between rear ends of bottom portions of the L-shaped side walls 16, and the locking mechanism 25 is provided on an upper surface of the bottom portion of each side wall 16 in a position slightly shifted forward from the locking mechanism 24.

Figure 8A:
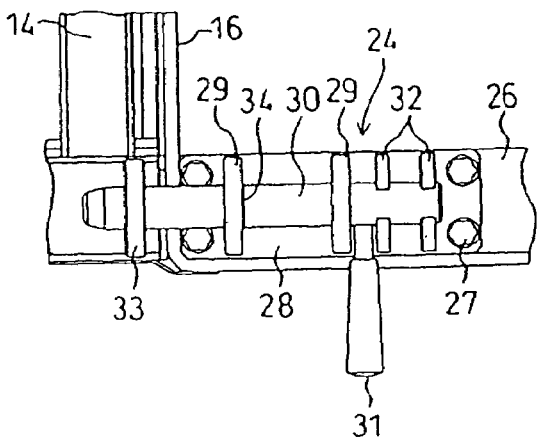
FIG. 8 is a view showing in detail a locking mechanism for a rear wall of the hopper provided in one embodiment of the wood crusher according to the present invention.
Figure 8B:
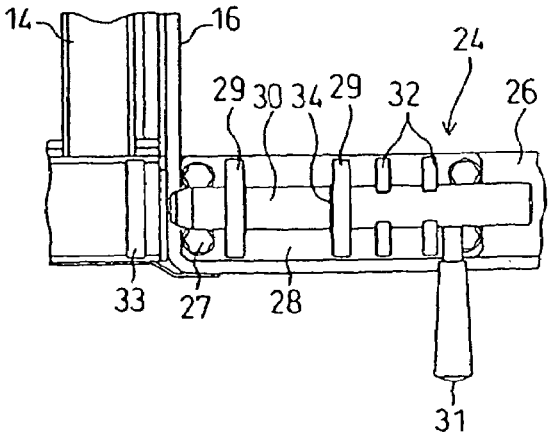

FIGS. 8A and 8B are each a view showing the locking mechanism 24 in detail, the view being looked in the same direction as that in FIG. 6. Similar components in FIGS. 8A and 8B to those in the above-described drawings are denoted by the same symbols and a description of those components is omitted here. Note that, though not described in detail, the locking mechanism 25 is constructed similarly to the locking mechanism 24. Also, the locking mechanisms 24 and 25 are provided in the same structure per each of both the sides in the transverse direction (vertical direction in FIG. 2) of the self-propelled wood crusher. FIGS. 8A and 8B show one of both the sides.

Referring to FIGS. 8A and 8B, the locking mechanism 24 comprises a support plate 28 fixed to the beam 26 by a plurality of bolts 27, two brackets 29 provided on the support plate 28 at a predetermined spacing between them, a pin 30 penetrating the brackets 29, a handle 31 projecting from an outer periphery of the pin 30 substantially at a right angle, a latch member 32 for latching the handle 31 in place, and a bracket 33 fixed to a lower end of the rear wall 14.

With such a structure, as shown in FIG. 8A, when the pin 30 is inserted through the bracket 33 provided on the rear wall 14 and the handle 31 is latched between the bracket 29 and the latch member 32, the rear wall 14 is secured to the side wall 16 through the pin 30 and the rear wall 14 is held in the closed state. On the other hand, when the handle 31 is rotated together with the pin 30 to take a substantially horizontal position and is slid together with the pin 30 while passing through a cut portion of the latch member 32 to such an extent that the pin 30 is withdrawn from the bracket 33 as shown in FIG. 8B, the rear wall 14 is released from state restrained to the side wall 16. Since there is another locking mechanism 25, a pin of the locking mechanism 25 is also withdrawn from a bracket provided on the rear wall 14 in a similar way. In this embodiment, since another set of the locking mechanisms 24 and 25 is disposed on the other side of the self-propelled wood crusher in the transverse direction, respective pins of those locking mechanisms 24 and 25 are further released in a similar way. As a result, the rear wall 14 is completely released from the restrained state so that the rear wall 14 can be opened and closed.

Figure 9:
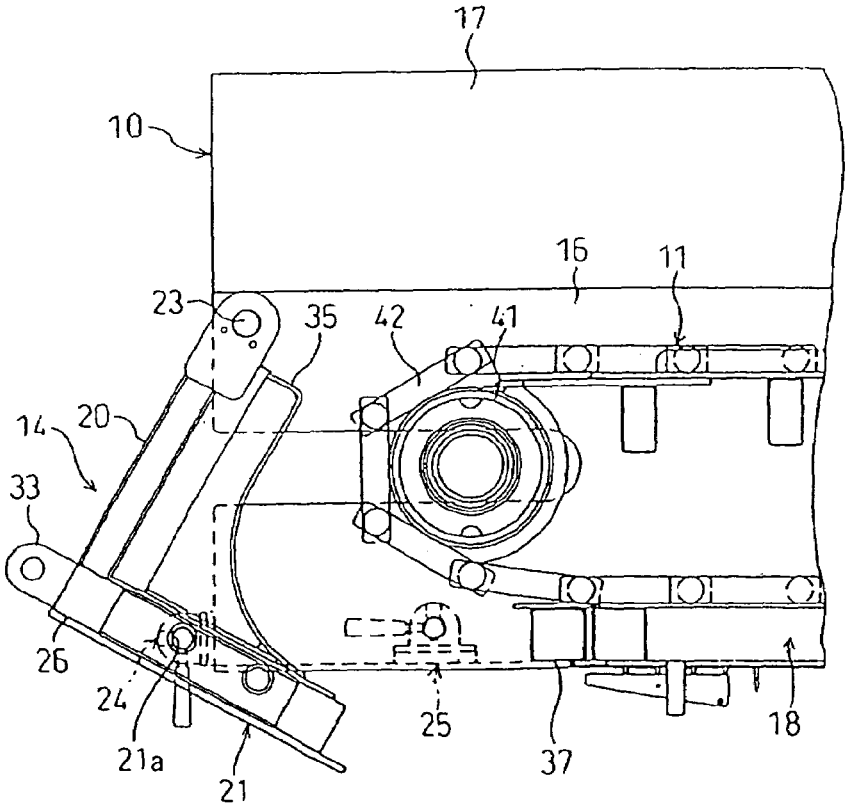
FIG. 9 is a view showing an open state of the rear wall of the hopper provided in one embodiment of the wood crusher according to the present invention.

The open state of the rear wall 14 is shown in FIG. 9 that corresponds to FIG. 7. As shown in FIG. 9, the rear wall 14 can be held in an open state (namely, the locking mechanism 24 serves also as a locking mechanism for holding the rear wall 14 in the open state) by returning again the pin 30 of the locking mechanism 24 to the position shown in FIG. 8B and inserting the pin 30 through an opening 21*a* formed in the bottom wall portion 21 of the rear wall 14 in the state where the rear wall 14 is opened after rotating the rear wall 14 with respect to the side wall 16. Thus, working efficiency and safety of the operator can be improved when the rear wall 14 is opened and cleaning of the hopper 10 is performed.

Additionally, numeral 34 denotes a snap ring for preventing slipping-off of the pin 30. The snap ring 34 is fitted over the outer periphery of the pin 30 to be located between the two brackets 29 and 29. In this embodiment, the snap ring 34 is disposed at such a position as causing it to abut against the inner and outer brackets 29 in the locked state shown in FIG. 8A and the unlocked state shown in FIG. 8B, respectively, whereby the stroke of the pin 30 is limited to a proper length.

Returning to FIGS. 3, 4 and 7, the feed conveyor 11 comprises a sprocket-like drive wheel 40 (see FIG. 3) disposed on the side close to a crushing rotor 61 (described later), a driven wheel 41 (see FIG. 7, etc.) disposed on the opposite side (i.e., on the rear side of the wood crusher or the side close to the rear wall 14), and running members 42 (i.e., conveyor belts or chain belts) 42 looped between the drive wheel 40 and the driven wheel 41 at opposite ends of the feed conveyor 11 in the feed direction and disposed in plural rows (four in this embodiment, see FIG. 2) side by side in the transverse direction.

The driven wheel 41 is supported by a bearing 43 (see FIG. 4) mounted to an outer wall surface of the side wall 16 of the hopper 10 in a rear portion of the side wall 16, and the drive wheel 40 is supported by a bearing (not shown) mounted to an outer wall surface of the side cover 45 (see FIG. 3) which is a frame of the crushing apparatus 12, the side cover 45 being provided forward of the side wall 16 so as to position substantially in flush with it. Thus, the feed conveyor 11 is disposed to substantially horizontally extend from a lower position inside the hopper 10, i.e., the inner side of the side wall 16 of the hopper 10, to a position near the crushing rotor 61 (described later) such that the feed conveyor 11 is entirely accommodated within the hopper 10 and the side covers 45 of the crushing apparatus 12.

Returning to FIG. 3, a rotary shaft 46 of the drive wheel 40 of the feed conveyor 11 is coupled through, e.g., a coupling to an output shaft of a driving unit (i.e., a hydraulic motor for the feed conveyor, not shown) that is provided externally of the bearing in the transverse direction. By rotating the not-shown driving unit, the feed conveyor 11 is driven to move the conveyor running members 42 between the drive wheel 40 and the driven wheel 41 in a circulating manner.

Numeral 47 denotes a guide member that is disposed in continuation with the bottom wall 18 and the front wall 19 of the hopper 10 and is formed so as to curve in proximity to a locus along which the drive wheel 40 is rotated. Numeral 48 denotes a scraper mounted to an upper portion of the front wall 19 in a position slightly lower than the top of the rotation locus of the drive wheel 40 such that a scraper end opposed to the drive wheel 40 is positioned as close as possible to the rotation locus of the drive wheel 40. Opposite ends of each of the guide member 47 and the scraper 48 in the transverse direction are fixed to the side covers 45 of the crushing apparatus 12.

The pressing conveyor unit 13 is provided adjacently rearward of the crushing rotor 61 (described later) in opposed relation to the conveying surface (upper run side) of the feed conveyor 11 over which the target woods to be crushed are conveyed. The pressing conveyor unit 13 comprises a support member 52 that has a rotary shaft 51 journalled by the crusher side cover 45 through a bearing 50 and is hence supported to be rotatable in a vertical plane (i.e., swingable up and down), and a pressing roller 53 provided rotatably relative to the support member 52.

The support member 52 comprises an arm portion 54 provided with the rotary shaft 51, and a bracket portion 55 provided at the distal end side of the arm portion 54 and supporting the pressing roller 53. A lower end surface of the arm portion 54 is formed to curve in a circular-arc shape, and a curved plate 68 defining a part of a crushing chamber 60, described later, is attached to the lower curved surface of the arm portion 54. On the other hand, a mount area of the bracket portion 55 to which the pressing roller 53 is mounted is formed in a circular-arc shape having a smaller diameter than the pressing roller 53 such that an outer circumferential surface of the pressing roller 53 projects out of the bracket portion 55. The dimension of the pressing roller 53 in the transverse direction (i.e., in the direction perpendicular to the drawing sheet of FIG. 3) is set equal to or larger than the width of the conveying surface of the feed conveyor 11.

Though not specifically shown, the pressing roller 53 includes a driving unit (i.e., a hydraulic motor for the pressing roller) mounted within its barrel. The pressing roller 53 is rotated by the not-shown driving unit to move in the same direction as the conveying surface of the feed conveyor 11 in an oppositely faced relation substantially at the same circumferential speed as the conveying speed of the target woods, thereby pressing the target woods on the feed conveyor 11 and introducing them to the crushing apparatus 12 in cooperation with the feed conveyor 11.

The crushing apparatus 12 is mounted substantially on a central portion of the body frame 36 in the longitudinal direction. As shown in FIG. 3, the crushing apparatus 12 comprises a crushing rotor 61 rotating in the crushing chamber 60 at a high speed, and an anvil 62 disposed opposite to the crushing rotor 61 to face against the rotating direction (i.e., the forward rotating direction or the clockwise direction in FIG. 3) of the crushing rotor 61. Though described later in detail, the anvil 62 is constructed to be able to retract in a direction following the forward rotating direction of the crushing rotor 61 (see FIG. 12), for example, when an excessive impact is applied to the anvil.

The crushing rotor 61 is rotatably supported by bearings (not shown) each of which is mounted to, e.g., the side cover 45 of the crushing apparatus 12 (or a not-shown support member separately provided on the body frame 36). A plurality of support members 64 and crushing bits (i.e., bump plates or crushing blades) 65 mounted respectively to the support members 64 are provided on an outer circumferential surface of the crushing rotor 61. The crushing bits 65 are arranged such that their edge faces precede the corresponding support members 64 when the crushing rotor 61 is rotated in the forward direction (i.e., the clockwise direction in FIG. 3). Also, the crushing bits 65 are fixed to the support members 64 by bolts 66 or the likes, and therefore they are easily replaceable when worn out. Numeral 67 denotes a driving unit (i.e., a hydraulic motor for the crushing rotor) for rotating the crushing rotor 61. Though not specifically shown, the driving unit 67 is fixed to the side cover 45 of the crushing apparatus 12 by bolts or the likes and has an output shaft coupled to a rotary shaft of the crushing rotor 61 through, e.g., a V-belt.

The crushing chamber 60 is substantially defined by the above-mentioned curved plate 68 disposed above the crushing rotor 61, and a first screen (sieve member) 69 and a second screen (sieve member) 70 which are disposed respectively forward of and under the crushing rotor 61 and have a large number of holes formed in an appropriate diameter to set a grain size of the crushed woods (wood chips). The crushing chamber 60 is opened at the rear side to provide a target-wood receiving area. The curved plate 68 is attached to the lower curved surface of the arm portion 54 of the pressing conveyor unit 13, as described above, and it is movable with vertical swing motion of the pressing conveyor unit 13. Similarly to the curved plate 68, the first and second screens 69, 70 are formed in a curved shape so as to extend substantially along the rotation locus of the crushing rotor 61 while predetermined gaps are kept relative to the crushing bits 65 during the crushing work, both the screens being mounted in a demountable (replaceable) manner (described later in detail).

Further, in this embodiment, the first screen 69 is positioned above the rotation center of the crushing rotor 61 on the side away from the end of the feed conveyor 11 downstream in the feed direction of the target woods to be crushed (i.e., away from the downstream end thereof) with the crushing rotor 61 interposed between them, and the second screen 70 is positioned below the rotation center of the crushing rotor 61 in its entirety between the downstream end of the feed conveyor 11 and the first screen 69.

Figure 10:
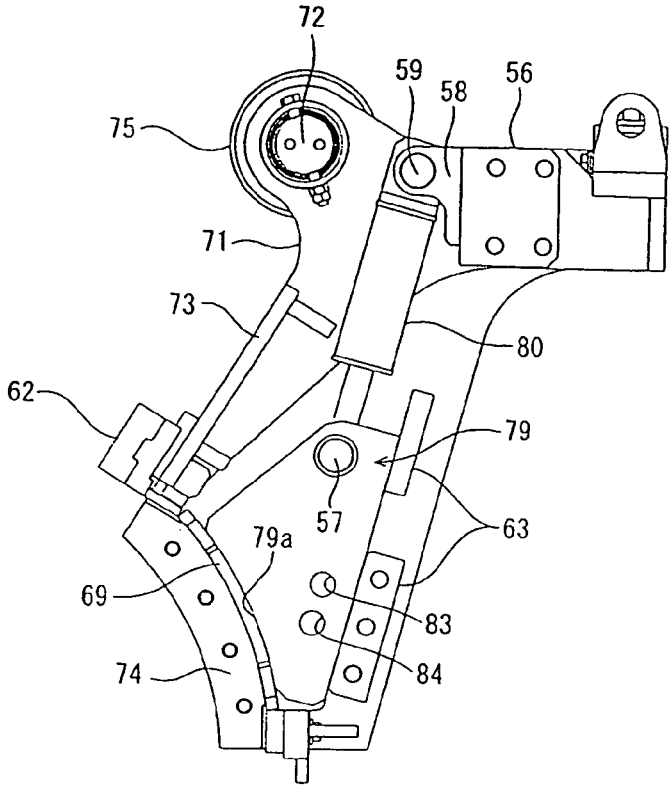
FIG. 10 is a side view showing, in the extracted form, a structure in the vicinity of an anvil and a first screen which are provided in one embodiment of the wood crusher according to the present invention, the view showing, partly in section, details of a mechanism for moving the anvil and the first screen.
Figure 11:
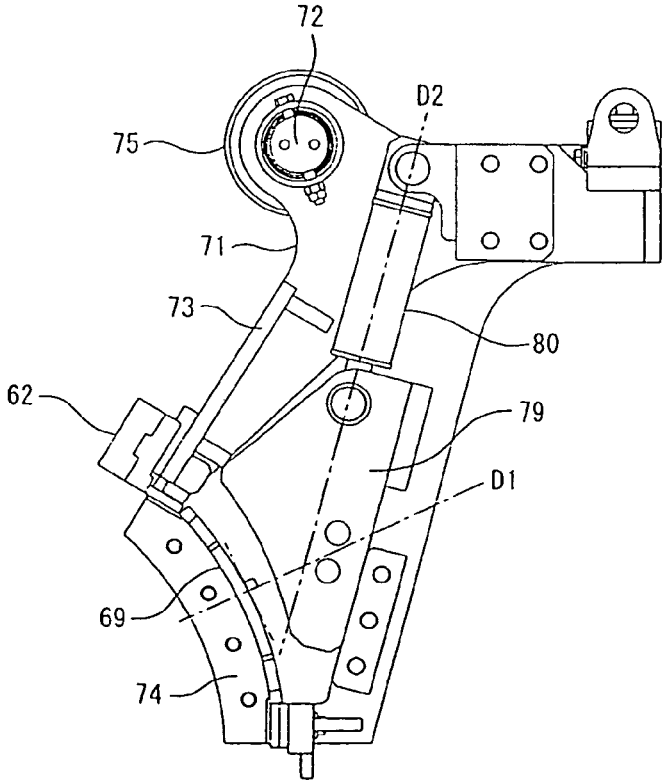
FIG. 11 is a side view showing, in the extracted form, the structure in the vicinity of the anvil and the first screen which are provided in one embodiment of the wood crusher according to the present invention, the view showing, partly in section, details of the mechanism for moving the anvil and the first screen when the first screen is replaced.

FIGS. 10 and 11 are each a side view showing, in the extracted form, a structure in the vicinity of the anvil 62 and the first screen 69, the view showing, partly in section, details of a mechanism for moving the anvil 62 and the first screen 69. Similar components in FIGS. 11 and 12 to those in the above-described drawings are denoted by the same symbols and a description of those components is omitted here.

Referring to FIGS. 10 and 11, numeral 71 denotes an arm disposed in pair in spaced relation in the transverse direction (i.e., a direction perpendicular to the drawing sheets of FIGS. 10 and 11). The arms 71, 71 are connected to each other by a rotary shaft 72, a fixed tooth support member 73, a screen support member (sieve member holding means) 74, a guide member 63, a coupling member 56, and so on. The rotary shaft 72 is supported by bearings 75 each mounted to the outer wall surface of the crusher side cover 45 such that the arms 71, 71 are rotatable about the rotary shaft 72 serving as a fulcrum. The rotary shaft 72 is extended in a direction substantially parallel to the rotary shaft of the crushing rotor 61.

Figure 12:
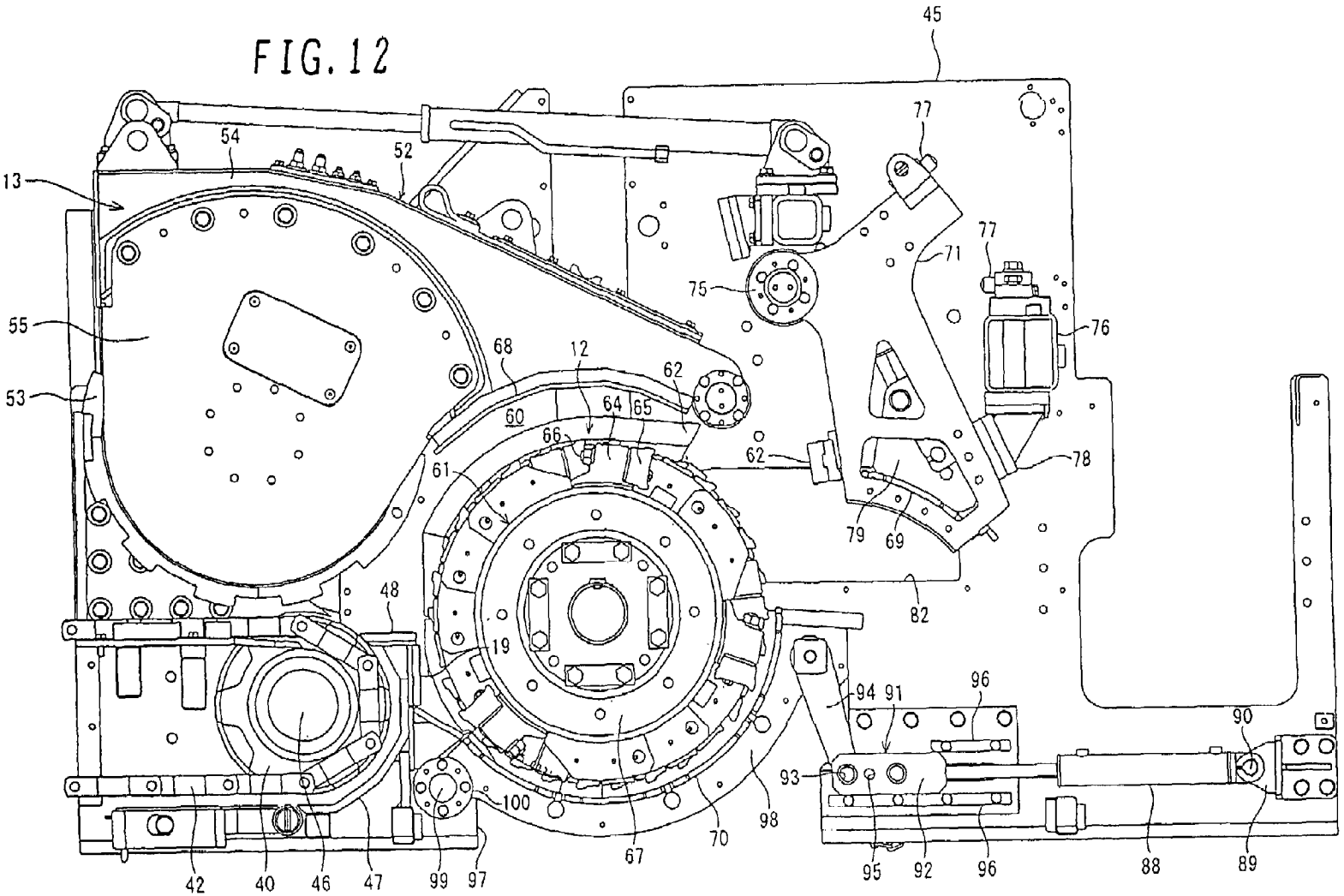
FIG. 12 is a side view showing a detailed structure within the side cover in the vicinity of the crushing apparatus provided in one embodiment of the wood crusher according to the present invention when the anvil is retracted.

A front end of each arm 71 is coupled through a shear pin 77 (see FIG. 3) to a support member 76 (see FIG. 3) fixed to the crusher side cover 45. Also, the arms 71 are fixed and held in such a posture that, during the crushing work (e.g., in the state shown in FIG. 3), the anvil 62 is positioned on one side (i.e., the right side as viewed in FIG. 3) of the curved plate 68 in the circumferential direction thereof (i.e., in the circumferential direction of the crushing rotor 61) and is projected inward of an inner wall surface of the curved plate 68 in the radial direction thereof (i.e., in the radial direction of the crushing rotor 61). Accordingly, for example, when an impact load in excess of an allowable limit set for the shear pin 77 is applied to the anvil 62, the shear pin 77 is broken, whereby each arm 71 is released from the restrained state and is turned about the rotary shaft 72 serving as a fulcrum to be retracted from the crushing chamber 60. As a result, the associated components are protected from damages. The state in such a case is shown in FIG. 12 that corresponds to FIG. 3. Additionally, numeral 78 denotes a stopper fixed to the support member 76. As shown in FIG. 12, the stopper 78 limits an allowable range of the angular turning of the arm 71 in the direction in which the anvil 62 is retracted, to thereby prevent interference between the arm 71 and any other components.

The turning of the arm 71 in the above case is detected by, e.g., a not-shown limit switch. When the turning of the arm 71 is detected, a not-shown controller outputs a command signal for stopping the driving unit 67 of the crushing rotor 61.

Returning to FIGS. 10 and 11, the fixed tooth support member 73 is disposed between the arms 71 and 71 on the rear side thereof. The anvil 62 is mounted to the fixed tooth support member 73 in a replaceable way by not-shown bolts. Further, the screen support member (screen holder) 74 in the form of a frame is disposed between the arms 71 and 71 on the lower side thereof, and the first screen 69 is mounted to the screen support member 74 in a replaceable way.

Numeral 79 denotes an abutment member having an abutment surface 79*a* formed following a curved surface of the first screen 69 and having a wedge-like shape tapered toward a fore end. Numeral 80 denotes a hydraulic cylinder (extension/contraction drive means) having a rod-side end rotatably coupled to the abutment member 79 through a pin 57 and having a bottom-side end rotatably coupled through a pin 59 to a bracket 58 which is provided on the coupling member 56. The abutment member 79 and the hydraulic cylinder 80 are each disposed, for example, in one pair (or more pairs) in spaced relation in the transverse direction (i.e., the direction perpendicular to the drawing sheets of FIGS. 10 and 11). The abutment member 79 is moved by the hydraulic cylinder 80 toward and away from the first screen 69. On that occasion, the moving direction of the abutment member 79 is guided by the guide member 63 disposed between the arms 71 and 71 so as to follow a direction (indicated by a one-dot-chain line D2 in FIG. 11) that is inclined relative to a direction (indicated by a one-dot-chain line D1 in FIG. 11) normal to an abutment portion between the first screen 69 and the abutment member 79 (abutment surface 79*a*). Further, the abutment member 79 has insert holes 83, 84 formed therein for insertion of a lock pin (not shown) for fixing the position of the abutment member 79. When the lock pin is inserted through both the insert hole 83 and another insert hole 86 (see FIG. 3) which is formed in a locking member (locking device) 85 (see FIG. 3) fixed to the arm 71, the position of the abutment member 79 is fixed in the state where the abutment member 79 is abutted against the first screen 69 (i.e., the state shown in FIGS. 3 and 10). On the other hand, when the lock pin is inserted through both the insert hole 84 and the insert hole 86, the position of the abutment member 79 is fixed in the state where the abutment member 79 is away from the first screen 69 (i.e., the state shown in FIG. 11).

With such an arrangement, in ordinary crushing work, the hydraulic cylinder 80 is extended to urge the abutment member 79 to be pushed like a wedge into between the first screen 69 and the guide member 63, thereby fixedly holding the first screen 69. On the other hand, in the case of screen replacement work, the hydraulic cylinder 80 is contracted to move the abutment member 79 away from the first screen 69. As a result, the first screen 69 can be withdrawn in the axial direction of the crushing rotor 61 for easy replacement of the first screen 69. In this connection, for facilitating the replacement work of the first screen 69, an opening 81 (see FIG. 3) through which the first screen 69 is withdrawn and inserted is formed in the arm 71. Further, an opening 82 (see FIG. 3) is also formed in the crusher side cover 45 for facilitating the replacement work of the first screen 69. The operator can withdraw or insert the first screen 69 in the axial direction of the crushing rotor 61 through those openings 81 and 82. Though not specifically shown, for example, a cover is attached to the opening 82 of the crusher side cover 45 in a detachable manner using bolts.

The operation of extending and contracting the hydraulic cylinder 80 is performed through a selector switch 103 (see FIG. 15 described later) of a console 101 provided on the crusher side cover 45 (as described in detail later).

As a modification, the position of the abutment member 79 (i.e., the extended or contracted state of the hydraulic cylinder 80) may be detected by a not-shown limit switch, for example, and upon detection of release of the abutment member 79 from the fixing position, the not-shown controller may output a command signal to inhibit the operation of the driving device 67 for the crushing rotor 61. Such a modification is effective in avoiding the crushing work from being performed in the state where the first screen 69 is not set, and hence preventing troubles such as damages of various components and discharge of the crushed woods from the crushing apparatus 12, which are not passed through the first screen 69 (i.e., which are not adjusted in grain size), with the first screen 69 not properly fixed and dislodged from a predetermined position. It is hence possible to improve safety and to prevent deterioration in quality of the wood chips.

Returning to FIG. 3, numeral 98 denotes a frame-like screen support member (screen holder) for holding the second screen 70 in a position around the crushing rotor 61. The screen support member (sieve member holding means) 98 has a rotary shaft 99 provided at one end of the screen support member 98 on one side (i.e., the left side as viewed in FIG. 3) in the circumferential direction thereof (i.e., in the circumferential direction of the crushing rotor 61), and the rotary shaft 99 is supported by a bearing 100 fixed to the crusher side cover 45 (or a not-shown support member separately provided on the body frame 36) such that the screen support member is rotatable in the vertical direction (i.e., in a direction toward and away from the crushing rotor 61). The rotary shaft 99 is extended parallel to the rotation center of the crushing rotor 61. Thus, the screen support member 98 is rotatably supported to, e.g., the crusher side cover 45 with the rotary shaft 99 serving as a fulcrum, whereby the screen support member 98 is movable toward and away from the crushing rotor 61.

The screen support member 98 defines a part of the outer circumference of the crushing chamber 60 in a posture where the screen support member 98 is turned upward with the rotary shaft 99 serving as a fulcrum and is positioned closest to the crushing rotor 61 (i.e., when the screen support member 98 is in its posture shown in FIG. 3). The wood crushing work is performed in that state. During the wood crushing work, the second screen 70 is firmly held while being sandwiched between a circular-arc-shaped retainer plate 87 (see FIGS. 13 and 14 described later) fixed to the crusher side cover 45 and the screen support member 98. On the other hand, when the screen support member 98 is turned downward from the state shown in FIG. 3 with the rotary shaft 99 serving as a fulcrum by using a mechanism described later in detail and is shifted to a posture most remote from the crushing rotor 61, the second screen 70 is moved away from the retainer plate 87 and an end surface of the second screen 70 which faces in the axial direction of the crushing rotor is descended to a position where the end surface confronts a later-described cutout 97 (see FIG. 3) formed in a lower end portion of the crusher side cover 45. In such a state, by withdrawing and inserting the second screen 70 through the cutout 97 in the axial direction of the crushing rotor, the second screen 70 can be removed from and placed on the screen support member 98.

Numeral 88 denotes a hydraulic cylinder (extension/-contraction drive means) having a bottom-side end rotatably coupled through a pin 90 to a bracket 89 fixed to the crusher side cover 45, and 91 denotes a link mechanism for converting the extension and contraction of the hydraulic cylinder 88 to the movement of the screen support member 98 toward and away from the crushing rotor 61. The link mechanism 91 comprises a slide link (first link member) 92 disposed at a rod-side end of the hydraulic cylinder 88 and being movable in the extending/contracting direction of the hydraulic cylinder 88, and a hold link (second link member) 94 having one end (upper end in FIG. 3) rotatably coupled through a pin 93*a* to an end (right end in FIG. 3) of the screen support member 98 on the other side in the circumferential direction thereof and having the other end (lower end in FIG. 3) rotatably coupled to the slide link 92 through a pin 93. As in the abutment member 79, the slide link 92 has an insert hole 95 formed therein for insertion of a lock pin (not shown) for fixing the position of the slide link 92. Also, not-shown two insert holes (i.e., a set-position insert hole and a replacement-position insert hole) are formed in the crusher body cover 45 in spaced relation in the moving direction of the slide link 92. With such an arrangement, when the lock pin is inserted through both the set-position insert hole and the insert hole 95, the position of the slide link 92 is fixed in the state where the screen support member 98 is positioned (set position) closest to the crushing rotor 61 (i.e., the state shown in FIG. 3). On the other hand, when the lock pin is inserted through both the replacement-position insert hole and the insert hole 95, the position of the slide link 92 is fixed in the state where the screen support member 98 is positioned (replacement position) most away from the crushing rotor 61 (i.e., the state shown in FIG. 14 described later).

Numeral 96 denotes a guide member for guiding the slide link 92 in a direction in which it is moved, and for bearing a vertical load applied to the slide link 92 from the hold link 94.

Figure 13:
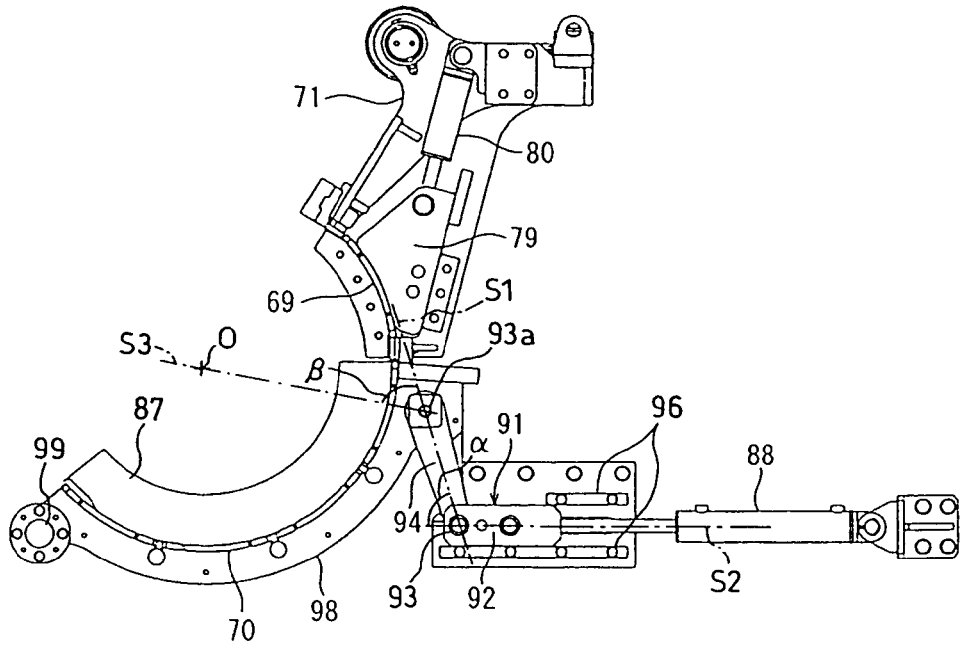
FIG. 13 is a side view showing, in the extracted form, a structure in the vicinity of the first screen and a second screen which are provided in one embodiment of the wood crusher according to the present invention, the view showing, partly in section, details of a mechanism for moving the first screen and the second screen.

FIG. 13 is a side view showing, in the extracted form, a structure in the vicinity of the first screen 69 and the second screen 70, the view showing, partly in section, details of a mechanism for moving the first screen 69 and the second screen 70. Similar components in FIG. 13 to those in the above-described drawings are denoted by the same symbols and a description of those components is omitted here.

Figure 14:
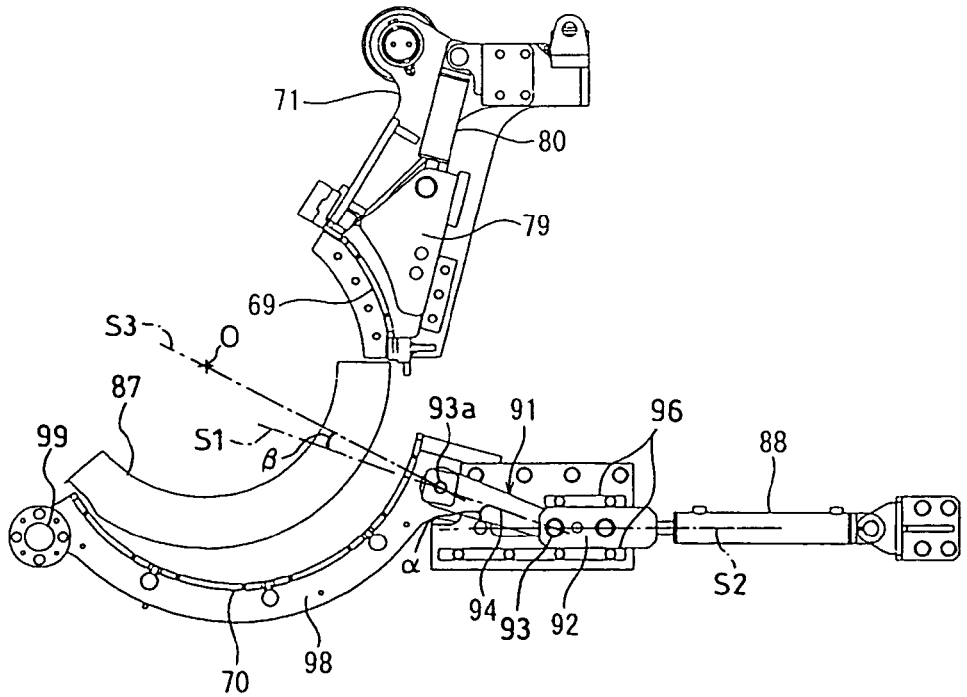
FIG. 14 is a side view showing, in the extracted form, a structure in the vicinity of the first screen and the second screen which are provided in one embodiment of the wood crusher according to the present invention, the view showing, partly in section, details of the mechanism for moving the first screen and the second screen when the screens are replaced.

As shown in FIG. 13, in the ordinary crushing work, the hydraulic cylinder 88 is extended to bring the slide link 92 and the hold link 94 of the link mechanism 91 into an angularly coupled state crossing each other substantially at a right angle, whereby the screen support member 98 takes the set position. In this embodiment, during the crushing work (i.e., when the screen support member 98 is in the "set position" closest to the crushing rotor 61), the hold link 94 is positioned to extend (or incline nearly) in the tangential direction of a circular-arc section of the inner circumferential surface (i.e., the first screen 69 or the second screen 70) of the crushing chamber 60. As the hydraulic cylinder 88 is contracted from that state, the slide link 92 and the hold link 94 are turned to gradually open relative to each other and the screen support member 98 is gradually moved (descended) in a direction away from the crushing rotor 61. Finally, when the hydraulic cylinder 88 comes into the maximally contracted state, the slide link 92 and the hold link 94 are substantially fully opened relative to each other, whereby the screen support member 98 is brought into the replacement position most away from the crushing rotor 61. Such a state is shown in FIG. 14 that correspond to FIG. 13. Thus, the second screen 70 can be withdrawn in the axial direction of the crushing rotor 61 for easy replacement of the second screen 70.

In the above state, an angle formed between a plane S1 passing rotation centers ○ of the pins 93, 93*a* supporting the hold link 94 and a plane S2 passing the rotation center of the pin 93 and extending in the sliding direction of the slide link 92 is assumed to be $\alpha$. The angle $\alpha$ represents an angle formed above the plane S2 on the side of the pin 93*a* closer to the crushing rotor 61. On such an assumption, when the screen support member 98 is turned at least for mounting and demounting the second screen 70, it is desired that the operating range of the link mechanism 91 or the stroke of the hydraulic cylinder 88 be limited to a range ($0<\alpha\leqq 90°$) where the plane S1 is always inclined upward while advancing in the extending direction of the hydraulic cylinder 88. More specifically, in a range of $\alpha<0$, even when the hydraulic cylinder 88 is extended to make the screen support member 98 come closer to the crushing rotor 61, the screen support member 98 is urged to move in a direction away from the crushing rotor 61 by the action of the link mechanism 91. Also, if the hold link 94 is turned to a range of $\alpha>90°$ with the hydraulic cylinder 88 being further extended (namely, with the angle $\alpha$ being further increased) to make the screen support member 98 come closer to the crushing rotor 61, the action of the link mechanism 91 is reversed to urge the screen support member 98 to move away from the crushing rotor 61.

A rotation center ○ of the crushing rotor 61 is designed to be in match with a curvature center (circle center) of circular-arc sections of the first and second screens 69, 70, and with a curvature center of the retainer plate 87 formed in a circular-arc shape extending along the second screen 70. The term "match" used herein includes not only the case where the curvature center of each component and the rotation center ○ of the crushing rotor 61 are exactly matched with each other, but also the case where errors of the relevant components are kept within an accumulative range of manufacturing tolerances of those components.

Further, an angle formed between a plane S3 passing the rotation center ○ of the crushing rotor 61 and the rotation center of the pin 93*a* and the plane S1 is assumed to be $\beta$. On an assumption of the angle $\beta$ being thus defined, the link mechanism 91 is advantageously designed such that, during the crushing work (when the screen support member 98 is positioned closest to the crushing rotor 61), the planes S1 and S3 are perpendicular to each other ($\beta=90°$) and the hold link 94 takes a posture extending substantially in the tangential direction of a circle defining the curvature of the second screen 70, in order to most efficiently develop a force pressing the screen support member 98 against the retainer plate 87 (i.e., a force holding the second screen 70 between the screen support member 98 and the retainer plate 87) or a force urging the second screen 70 and the screen support member 98 to come close to the first screen 69 and the arms 71 without leaving gaps.

Stated another way, the angle $\alpha$ during the crushing work is preferably 90° from the viewpoints of not only moving the hold link 94 such that the screen support member 98 comes close to the crushing rotor 61 with the extension of the hydraulic cylinder 88, but also minimizing a component force of a force urging the screen support member 98 to open, which acts in the sliding direction of the slide link 92 (i.e., in the contracting direction of the hydraulic cylinder 88), to thereby prevent accidental opening of the screen support member 98. Further, the angle $\beta$ during the crushing work is also preferably 90° from the viewpoint of most efficiently converting the extending force of the hydraulic cylinder 88 to the force pressing the screen support member 98 against the retainer plate 87 through the link mechanism 91 when the screen support member 98 is moved in the closing direction.

Figure 16:
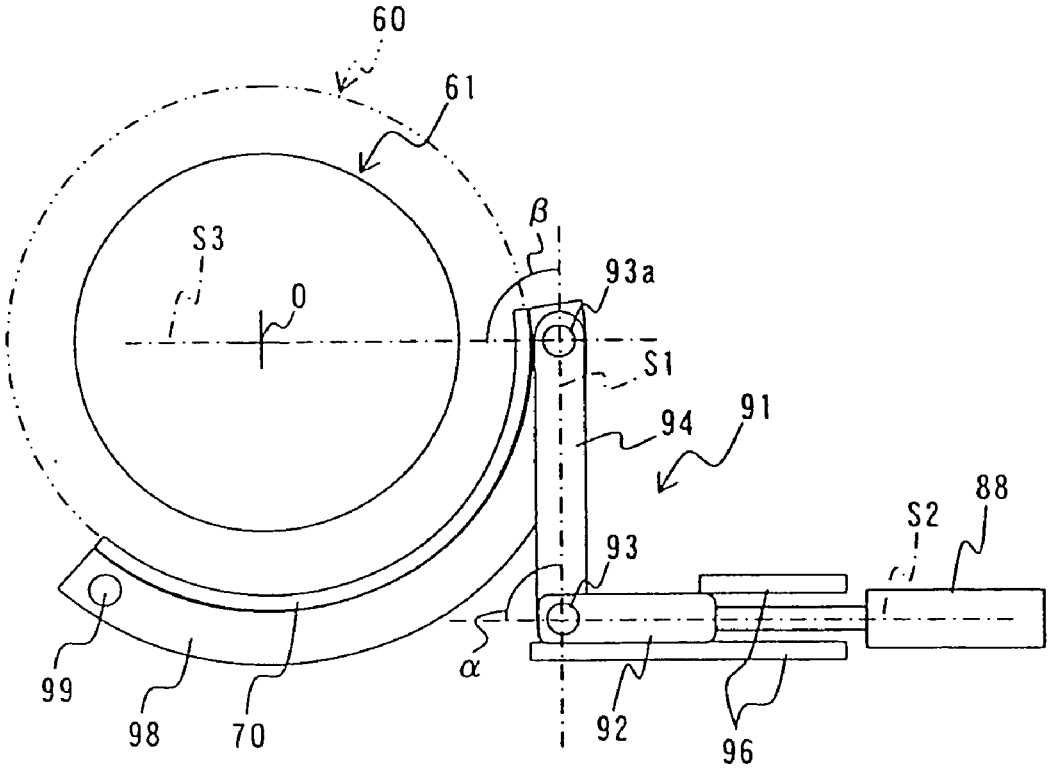
FIG. 16 is a side view showing, partly in section, another example of the structure of the crushing apparatus provided in the wood crusher according to the present invention.

Accordingly, by setting the angles $\alpha$ and $\beta$ to be each 90° when the screen support member 98 is in the set position, it is possible to most efficiently obtain the force acting to prevent the opening of the screen support member 98 and the force acting to close the screen support member 98, and to reduce the force imposed on the hydraulic cylinder 88 while improving safety. FIG. 16 schematically shows another example of the structure of the crushing apparatus which is designed in consideration of the positional relationship among the crushing rotor 61, the second screen 70, the hydraulic cylinder 88, the link mechanism 91, and the screen support member 98 with importance focused on the above-described point.

During the crushing work, a force acting to move the second screen 70 and the screen support member 98 away from the crushing rotor 61 is transmitted to the hold link 94. However, the closer to a right angle the angle $\alpha$ is, the smaller is a component of the force imposed on the hold link 94 which acts in the sliding direction of the slide link 92, and the larger is a component (i.e., the force pressing the screen support member 98 against the retainer plate 87) perpendicular to the above-mentioned component. In other words, the force urging the slide link 92 to slide is reduced and a frictional force acting between the slide link 92 and the guide member 96 is increased. That action is most effectively obtained at $\alpha$=90° as seen from FIG. 16.

Figure 17:
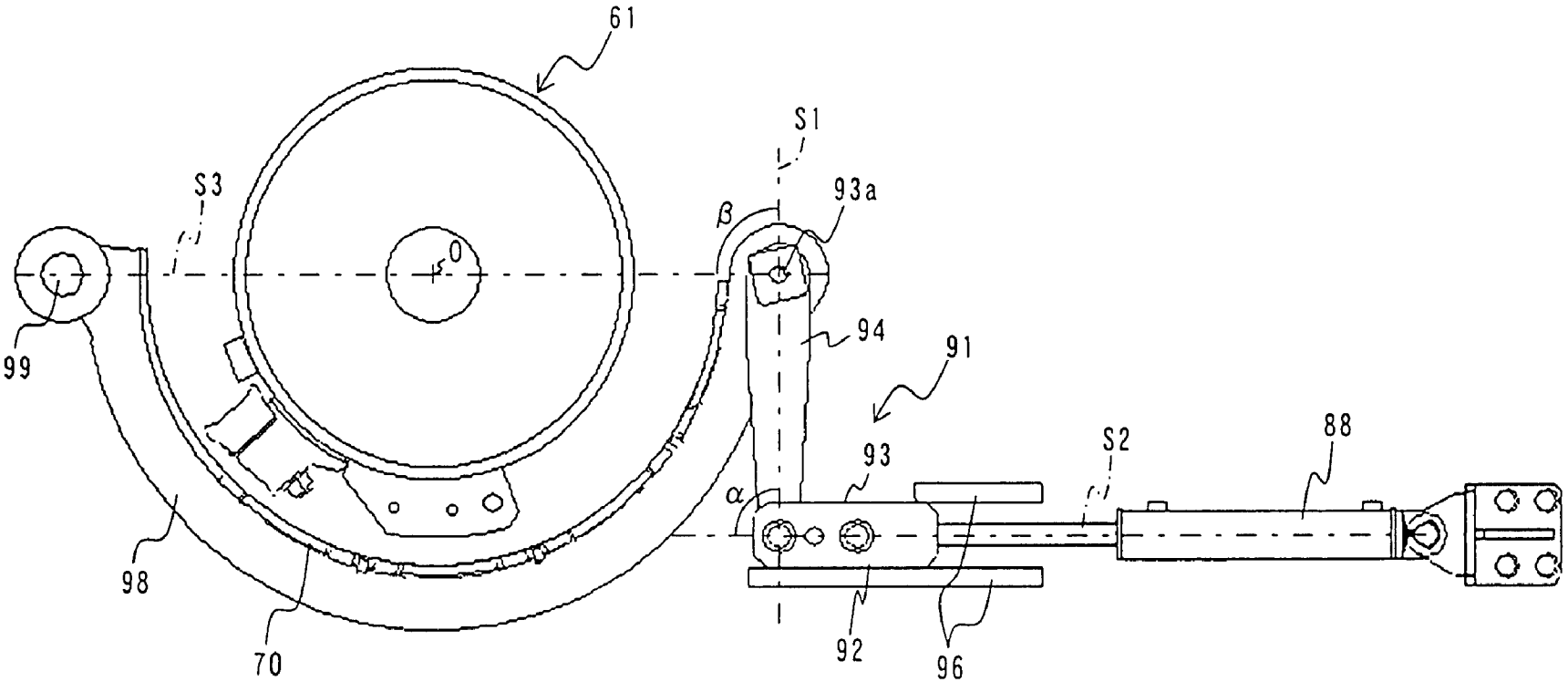
FIG. 17 is a side view showing, partly in section, still another example of the structure of the crushing apparatus provided in the wood crusher according to the present invention.

FIG. 17 shows still another example of the structure of the crushing apparatus in which the plane S3 is defined as a plane passing a rotation center of the pin 99 which couples the screen support member 98 to the crusher side cover 45. More specifically, the exemplary structure of FIG. 17 is modified from that of FIG. 16 in arranging the rotation center of the pin 99 to lie on the plane S3. The plane S3 is a plane passing the rotation center ○ of the crushing rotor 61, and it is also a plane passing the rotation center of the pin 93*a* that serves as a point for transmission of a force between the pin 99, i.e., a support point of the screen support member 98, and the link mechanism 91. By setting the plane S3 to be perpendicular to the plane S1 during the crushing work, a moment acting in a direction to open the screen support member 98 about the pin 99 as a center is applied to the hold link 94 along its axis (i.e., a line extending along the plane S1 on the drawing sheet of FIG. 16). Accordingly, it is possible to more reliably and effectively obtain the above-described action of reducing the component of the force urging the screen support member 98 in the opening direction which acts in the sliding direction of the slide link 92, while increasing the component perpendicular to the above component.

In any of the exemplary structures, because of a difficulty in making each of the angles $\alpha$ and $\beta$ exactly equal to the setting value, e.g., 90°, in practice due to working tolerances, manufacturing tolerances, etc., a certain allowable value is required to be given for the setting angle.

Further, as described above, the cutout 97 (see FIG. 3) is formed in the crusher side cover 45 for facilitating the replacement work of the second screen 70. The operator can withdraw and insert the second screen 70 in the axial direction of the crushing rotor 61 through the cutout 97. Though not specifically shown, for example, a cover is attached to the cutout 97 in a detachable manner using bolts.

The operation of extending and contracting the hydraulic cylinder 88 is performed through a selector switch 104 (see FIG. 15 described later) of the console 101 provided on the crusher side cover 45 (as described in detail later).

As a modification, the position of the screen support member 98 (i.e., the extended or contracted state of the hydraulic cylinder 88) may be detected by a not-shown limit switch, for example, and upon detection of separation of the screen support member 98 from the crushing rotor 61, the not-shown controller may output a command signal to inhibit the operation of the driving device 67 for the crushing rotor 61. Such a modification is effective in improving safety and to prevent deterioration in quality of the wood chips.

Figure 15:
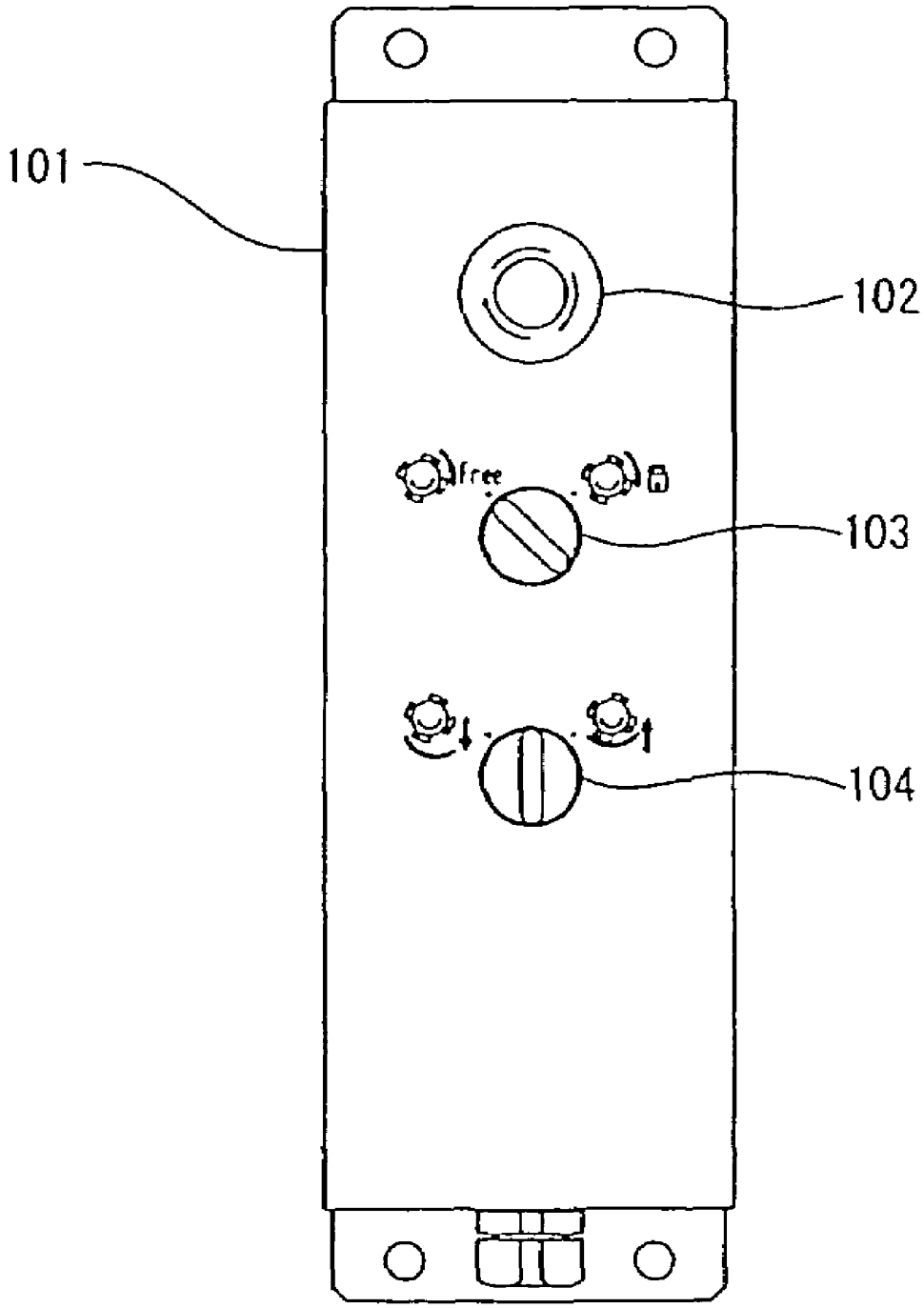
FIG. 15 is a view showing a front surface of a console used to operate a hydraulic cylinder for advancing and retracting an abutment member and a hydraulic cylinder for turning a screen support member, which are provided in one embodiment of the wood crusher according to the present invention.

FIG. 15 shows a front surface of the console 101 used to operate the hydraulic cylinders 80 and 88.

The console 101 is attached to the side cover 45 disposed at the lateral side of the crushing apparatus 12. The console 101 is in the form of a portable switch box such that it can be detached from the side cover 45 and carried with the operator. As shown in FIG. 15, the console 101 has an emergency stop button 102 and two selector switches 103, 104 in this order from the upper side.

The selector switch 103 is a switch for alternately selecting the locked state or the unlocked state of the first screen 69 (namely, for advancing or retracting, with respect to the first screen 69, the abutment member 79 for fixing the first screen 69) as described above. More specifically, when the first screen 69 is replaced, the selector switch 103 is changed over to an unlock position (i.e., a position where the switch 103 is turned in the counterclockwise direction in FIG. 14, or a Free position), whereby the hydraulic cylinder 80 is contracted to move the abutment member 79 away from the first screen 69. Thus, the first screen 69 is released from the fixed state and brought into a replaceable state. After completion of the replacement, the selector switch 103 is changed over to a lock position (i.e., a position where the switch 103 is turned in the clockwise direction in FIG. 14), whereby the hydraulic cylinder 80 is extended to move the abutment member 79 into abutment against the first screen 69. Thus, the first screen 69 is brought into the fixed state. In this embodiment, from the viewpoint of safety, the selector switch 103 is constituted as a momentary switch such that, when the operator does not perform the switch changing-over operation, the selector switch 103 is automatically returned to a neutral position (i.e., an intermediate position between the lock position and the unlock position), whereby the extending/contracting operation of the hydraulic cylinder 80 is stopped and the movement of the abutment member 79 is stopped.

Also, the selector switch 104 is a switch for selectively advancing or retracting the screen support member 98, which holds the second screen 70, with respect to the crushing rotor 61 as described above. More specifically, when the second screen 70 is replaced, the selector switch 104 is changed over to an away position (i.e., a position where the switch 104 is turned in the counterclockwise direction in FIG. 14), whereby the hydraulic cylinder 88 is contracted to move (descend) the screen support member 98 in a direction away from the crushing rotor 61 through the link mechanism 91. Thus, the second screen 70 is brought into a replaceable state. After completion of the replacement, the selector switch 104 is changed over to a close position (i.e., a position where the switch 104 is turned in the clockwise direction in FIG. 14), whereby the hydraulic cylinder 88 is extended to move (ascend) the screen support member 98 in a direction toward the crushing rotor 61 through the link mechanism 91. As a result, the screen support member 98 is fixed in the set position. Similarly to the selector switch 103, the selector switch 104 is also constituted as a momentary switch such that, when the operator does not perform the switch changing-over operation, the selector switch 104 is automatically returned to a neutral position (i.e., a position shown in FIG. 14), whereby the extending/contracting operation of the hydraulic cylinder 88 is stopped and the turning (ascend and descend) of the screen support member 98 is stopped.

When the emergency stop button 102 is depressed, the operations of the hydraulic cylinders 80 and 88 are stopped regardless of the changed-over states of the selector switches 103 and 104.

While the above description has been made as operating the hydraulic cylinders 80 and 88 from the console 101, the present invention is not limited to such an arrangement. For example, a pendant switch adapted for remote control may be provided so that the operator may operate the hydraulic cylinders 80 and 88 through remote control. Also, while momentary switches are employed as the selector switches 102 and 103 in the above description, the present invention is not limited to such an arrangement, and ordinary selector switches may be employed such that the hydraulic cylinders 80 and 88 are stopped when the operator changes over those selector switches to their neutral positions. Further, while the above description has been made, by way of example, of the case where the momentary switches for commanding the respective operations of extending and contracting the hydraulic cylinders 80 and 88 are provided as control switches for the hydraulic cylinders 80 and 88, it is also possible to separately provide a switch for commanding the operation of extending the hydraulic cylinder 80, a switch for commanding the operation of contracting the hydraulic cylinder 80, a switch for commanding the operation of extending the hydraulic cylinder 88, and a switch for commanding the operation of contracting the hydraulic cylinder 88. Of course, each of those switches is not limited to a momentary switch, and it may be constituted as a switch of the push button type. In that case, for example, the switches may be designed such that, when any of the switches is depressed, a hydraulic fluid is supplied to corresponding one of the hydraulic cylinders 80 and 88 in the corresponding direction during a time in which the switch is depressed, and the operation of that hydraulic cylinder 80 or 88 is stopped when the depression of the switch is ceased.

Returning to FIGS. 1 and 2, a portion of the discharge conveyor 3 on the discharge side (i.e., the front side or the right side as viewed in FIGS. 1 and 2) is supported in a suspended state by a support member 112 projecting from the power unit 4. Also, another portion of the discharge conveyor 3 on the opposite side (i.e., the rear side or the left side as viewed in FIGS. 1 and 2) is supported by a support member 113 in a state suspended from the body frame 36. Thus, the discharge conveyor 3 is disposed so as to pass under the crushing apparatus 12 and the power unit 4, and to further extend externally forward of the self-propelled wood crusher while inclining upward. Numeral 114 denotes a frame of the discharge conveyor 3, and 115 denotes a conveyor cover disposed over a conveyor belt (not shown) looped between a drive wheel (not shown) and a driven wheel (not shown) which are disposed at opposite ends of the frame 114 in the longitudinal direction thereof. Numeral 116 denotes a driving unit (i.e., a hydraulic motor for the discharge conveyor) for rotating the drive wheel. By rotating the driving unit 116, the conveyor belt is driven to circulate between the drive wheel and the driven wheel.

The power unit 4 is mounted on an end portion of the body frame 36 on the other side in the longitudinal direction (i.e., on the right side as viewed in FIGS. 1 and 2) through a support member 117. Behind the power unit 4, a cab 118 is provided in an area on one side (i.e., the lower side as viewed in FIG. 2) in the transverse direction. Numeral 119 denotes a control lever disposed in the cab 118 for the operation of travel, and 120 denotes a console used for performing other operations, setting, monitoring, etc. In this embodiment, the console 120 is disposed on the lateral side of the crusher body so that an operator can easily operate the console while standing on the ground, but it may be disposed in the cab 118.

In the foregoing, the not-shown lock pin and the locking member (locking device) 85 constitute a locking device for preventing movement of the abutment member 79, which is defined in claim 6.

The operations and effects of the thus-constructed wood crusher according to this embodiment will be described below in sequence.

When target woods to be crushed are loaded into the hopper 10 by using an appropriate working device, e.g., a grapple of a hydraulic excavator, the target woods are dropped to be put on the running members 42 of the feed conveyor 11 while being guided by the spreading portion 17 of the hopper 10. Then, the target woods are substantially horizontally conveyed toward the front side of the wood crusher with circulating motion of the running members 42 while being guided by the side walls 16 of the hopper 10.

When the target woods on the feed conveyor 11 are conveyed to a position near the pressing conveyor unit 13, they come into under the pressing roller 53 of the pressing conveyor unit 13 and push up the pressing conveyor unit 13. Then, the target woods on the feed conveyor 11 are introduced to the crushing chamber 60 in a state pressed and gripped between the pressing roller 53 and the feed conveyor 11 under the action of dead weight of the pressing conveyor unit 13. In the crushing, therefore, the target woods are projected into the crushing chamber 60 in the cantilevered form with their ends on one side gripped between the pressing roller 54 and the feed conveyor 11. The projected wood portions are smashed by the crushing bits 65 of the rotating crushing rotor 61 and are comparatively roughly crushed, i.e., subjected to primary crushing. The wood pieces having been subjected to the primary crushing are forced to move in the rotating direction of the crushing rotor 61 through a space in the crushing chamber 60 around the crushing rotor 61 while bumping against the anvil 62. With the impact forces caused upon bumping against the anvil, the target woods are more finely crushed, i.e., subjected to secondary crushing.

Of the wood pieces thus crushed and still under the crushing, those pieces having sizes larger than the diameter of many holes formed in the first and second screens 69, 70 continue to circulate in the crushing chamber 60 and are repeatedly smashed by the crushing bits 65 and bumped against the anvil 62 again so that the wood pieces are further crushed into smaller sizes. When the wood pieces are crushed into grain sizes enough to pass through the holes in the first and second screens 69, 70, the crushed woods (wood chips) are discharged from the crushing apparatus 12 after passing through the holes in the first and second screens 69, 70.

The crushed woods (wood chips) discharged from the crushing apparatus 12 are dropped on the conveyor belt 115 of the circulating discharge conveyor 3 through a chute (not shown). Thereafter, they are conveyed toward the front side (i.e., the right side as viewed in FIGS. 1 and 2) and are discharged as recycled articles.

In this embodiment, the grain size of the recycled articles (wood chips) is adjusted by preparing plural kinds of the first and second screens 69, 70 having different opening areas from each other and by replacing those screens as required. The work of replacing those screens is performed as follows.

First, the operator opens a door 133 (see FIG. 1) provided in the lateral side of the crushing apparatus 12. Then, the operator changes over the selector switch 103 of the console 101, which is disposed on the side cover 45, to the unlock position (i.e., the position where the switch 103 is turned in the counterclockwise direction in FIG. 15), thereby contracting the hydraulic cylinder 80 to move the abutment member 79 away from the first screen 69. Subsequently, the operator changes over the selector switch 104 to the away position (i.e., the position where the switch 104 is turned in the counterclockwise direction in FIG. 15), thereby contracting the hydraulic cylinder 88 to move the screen support member 98 away from the crushing rotor 61. As a result, the first screen 69 is brought into the state replaceable through the opening 82 of the side cover 45, and the second screen 70 is brought into the state replaceable through the cutout 97 of the side cover 45. The operator manually withdraws the first and second screens 69, 70 laterally of the crushing apparatus 12 and inserts new first and second screens 69, 70. After completion of the screen replacement, the screen support member 98 is returned to the original position and the first screen 69 is fixed in place through the procedures reversal to the above-described ones. The work of replacing the screens is thus ended.

According to this embodiment constructed and operated as described above, the following advantages can be obtained. In the related art, the operator performs the screen replacement by manually rotating the sling bolt with a tool, e.g., a wrench, and moving the screen support member to the replacement position. In contrast, with this embodiment, the operator can perform the operations of unlocking the first screen 69 and moving the screen support member 98 to the replacement position just by manipulating the selector switches 103 and 104 of the console 101. Especially, in the case of the structure in which the screen support member 98 is supported at plural points (two points at the opposite ends in this embodiment) in the axial direction of the crushing rotor like this embodiment, the related art is disadvantageous in that time and labor required for the operator to perform the replacement are increased in amount corresponding to an increase in the number of the sling bolts, and that the operator is required to evenly rotate two sling bolts disposed at two positions spaced in the axial direction of the crushing rotor. In particular, when the replacement work is performed by one person, a lot of time and labor are taken. In contrast, with this embodiment, the operator can operate the plurality of hydraulic cylinders 80 and 88 substantially evenly at the same time just by manipulating the selector switches 103 and 104. Even in the case of only one operator, therefore, it is possible to easily move (turn) the abutment member 97 and the screen support member 98. Thus, this embodiment can realize a great reduction in time and labor required for the screen replacement work.

Also, according to this embodiment, as described above, the abutment member 79 is moved toward and away from the first screen 69 in the direction inclined relative to the direction normal to the abutment portion between the first screen 69 and the abutment member 79 (abutment surface 79*a*) such that the abutment member 79 is pushed like a wedge into between the first screen 69 and the guide member 63, whereby the first screen 69 is fixedly held. Assuming, for example, a structure in which the abutment member 79 is abutted against the first screen 69 in the direction normal to the first screen 69, a force acting on the first screen 69 outward in the normal direction during the crushing work directly acts on the hydraulic cylinder 80 through the abutment member 79. In contrast, with this embodiment, because of employing the structure in which the abutment member 79 is abutted against the first screen 69 in the direction inclined relative to the direction normal to the first screen 69, only a component of the force acting on the first screen 69 outward in the normal direction during the crushing work is applied to the hydraulic cylinder 80 through the abutment member 79. As a result, the external force acting on the hydraulic cylinder 80 can be greatly reduced.

Further, according to this embodiment, as described above, when the screen support member 98 is in the set position, the slide link 92 and the hold link 94 of the link mechanism 91 are brought into the angularly coupled state crossing each other substantially at a right angle. Therefore, forces acting on the second screen 70 and the screen support member 98 during the crushing work, i.e., a vertical load acting on the slide link 92 from the hold link 94, can be substantially all borne by the guide member 96. As a result, since there is no need of providing another locking means for fixedly holding the screen support member 98 in the set position, the screen support member 98 can be moved to and locked in the set position by only one action of manipulating the selector switch 104 to extend the hydraulic cylinder 88. It is hence possible to cut time and labor required for the work of returning the second screen 70 to the proper position after the replacement thereof, and to realize the advantage of reducing total time and labor required for the screen replacement work. In addition, since the forces acting on the second screen 70 and the screen support member 98 during the crushing work can be substantially all borne by the guide member 96, the external force acting on the hydraulic cylinder 88 can be greatly reduced.

In the embodiment described above, the pressing conveyor unit 13 is employed as the means for pressing and introducing the target woods to be crushed, but the present invention is not limited to the above-described embodiment. For example, the pressing conveyor unit 13 may be replaced with a means including a drive roller and a driven roller between which an endless member (e.g., a belt or a chain) is looped. Also, the operation of pressing the target woods may be realized with vertical movement instead of the rotating operation. Those modifications can also provide similar advantages to those obtainable with the above-described embodiment.

Further, the present invention has been described above in connection with, by way of example, the wood crusher including the so-called impact crusher, as the crushing apparatus, in which blades (crushing bits 65) are mounted to the outer peripheral portion of the crushing rotor 61. However, the present invention is not limited to that type of crusher and can also be applied to wood crushers including other types of crushing apparatuses, such as a crushing apparatus in which cutters are provided over two shafts arranged parallel to each other and are rotated in opposite directions, to thereby shear target woods (e.g., a 2-shaft shearing machine including the so-called shredder), a rotary crushing apparatus in which a pair of roll-shaped rotating bodies (rotors) each provided with crushing blades are rotated in opposite directions, and target woods are crushed while passing between the rotating bodies in a sandwiched state (e.g., a 6-shaft crusher including the so-called roll crusher), and a wood crusher equipped with the so-called wood chipper for breaking the target woods into chips. Any of those cases can also provide similar advantages to those obtainable with the above-described embodiment.

Moreover, the above description has been made of, by way of example, the case where the present invention is applied to a self-propelled wood crusher, but the present invention is not limited to such an application. As a matter of course, the present invention is also applicable to, e.g., a mobile wood crusher capable of traveling with traction, a transportable wood crusher capable of being lifted by, e.g., a crane for transportation, and a stationary wood crusher installed as a fixed machine in a plant or the like. Any of those applications can also provide similar advantages to those obtainable with the above-described embodiment.

The invention claimed is:

1. A wood crusher comprising:

a crushing apparatus including a crushing rotor for crushing target wood to be crushed;

a sieve member detachably mounted on the outer peripheral side of said crushing apparatus;

sieve member holding means disposed on the outer peripheral side of said sieve member and holding said sieve member in a position on the outer peripheral side of said crushing apparatus;

a link mechanism coupled to said sieve member holding means; and extension/contraction drive means coupled to said link mechanism and advancing and retracting said sieve member holding means relative to said crushing apparatus with extension and contraction thereof;

wherein said link mechanism moves said sieve member holding means in a direction toward said crushing apparatus when said extension/contraction drive means is extended, and moves said sieve member holding means in a direction away from said crushing apparatus when said extension/contraction drive means is contracted, wherein said link mechanism is coupled to one end of said extension/contraction drive means and comprises a first link member movable in the extending and contracting direction of said extension/contraction drive means, and a second link member having one end rotatably coupled to said sieve member holding means and the other end rotatably coupled to said first link member, and wherein said link mechanism is constituted such that an angle (α) formed between a plane (S1) passing rotation centers of pins at opposite ends of said second link member and a plane (S2) passing the rotation center of said pin which couples said first and second link members and extending in the extending/contracting direction of said first link member is not larger than 90 degrees during crushing work, the angle (α) representing an angle formed above the plane (S2) extending in the extending/contracting direction of said first link member on the side of said pin, which couples said first and second link members, closer to said crushing rotor.

2. The wood crusher according to claim 1, further comprising a guide member for guiding a direction in which said first link member is moved, and for bearing a vertical load received by said first link member from said second link member.

3. The wood crusher according to claim 2, wherein an end of said sieve member holding means on the side oppositely away from said second link member is rotatably supported to a frame of said crushing apparatus about a pin serving as a fulcrum, which is extended parallel to a rotation center (○) of said crushing rotor, and said sieve member is held in a sandwiched state between a retainer plate fixed to said frame and said sieve member holding means.

4. The wood crusher according to claim 1, wherein said link mechanism is constituted such that an angle (β) formed between a plane (S1) passing rotation centers of pins at opposite ends of said second link member and a plane (S3) passing the rotation center of said pin which couples said sieve member holding means and said second link member and passing a rotation center (○) of said crushing rotor is 90 degrees during crushing work.

5. A wood crusher comprising:

a crushing apparatus including a crushing rotor for crushing target wood to be crushed;

a sieve member having a curved surface and detachably mounted on the outer peripheral side of said crushing apparatus;

sieve member holding means for holding said sieve member in a position on the outer peripheral side of said crushing apparatus;

an abutment member having an abutment surface formed in conformity with the curved surface of said sieve member;

a guide member for guiding a direction in which said abutment member is moved; and extension/contraction drive means for advancing and retracting said abutment member relative to said sieve member in a direction tat is inclined relative to a direction normal to an abutment portion between said sieve member and said extension/contraction drive means, wherein said abutment member is pushed like a wedge in between said sieve member and said guide member.

6. The wood crusher according to claim 5, further comprising a locking device for preventing movement of said abutment member when said abutment member is in a state abutted against said sieve member or a state most away from said sieve member.

* * * * *